US011395524B2

(12) United States Patent
Kim et al.

(10) Patent No.: US 11,395,524 B2
(45) Date of Patent: Jul. 26, 2022

(54) STROBEL FOR AN ARTICLE OF FOOTWEAR AND METHOD OF MANUFACTURING

(71) Applicant: NIKE, Inc., Beaverton, OR (US)

(72) Inventors: Ernest E. Kim, Portland, OR (US); Fabricio da Costa Pereira Machado, Portland, OR (US); Jeffrey S. To, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 149 days.

(21) Appl. No.: 16/671,825

(22) Filed: Nov. 1, 2019

(65) Prior Publication Data

US 2020/0170340 A1 Jun. 4, 2020

Related U.S. Application Data

(60) Provisional application No. 62/773,336, filed on Nov. 30, 2018.

(51) Int. Cl.

| | |
|---|---|
| ***A43B 13/14*** | (2006.01) |
| ***A43B 13/38*** | (2006.01) |
| ***A43B 13/18*** | (2006.01) |
| ***A43B 13/04*** | (2006.01) |
| ***A43B 13/12*** | (2006.01) |
| ***A43D 25/10*** | (2006.01) |

(52) U.S. Cl.

CPC ..... *A43B 13/181* (2013.01); *A43B 13/04* (2013.01); *A43B 13/125* (2013.01); *A43B 13/141* (2013.01); *A43B 13/188* (2013.01); *A43B 13/383* (2013.01); *A43D 25/10* (2013.01)

(58) Field of Classification Search

CPC ..... A43B 7/1485; A43B 13/127; A43B 13/38; A43B 13/383; A43B 13/386; A43B 13/39; A43B 13/40; A43B 13/41

See application file for complete search history.

(56) References Cited

U.S. PATENT DOCUMENTS

| | | | | |
|---|---|---|---|---|
| 1,433,309 A | | 10/1922 | Stimpson | |
| 1,741,999 A | * | 12/1929 | John | A43B 13/141 12/142 B |
| 2,012,914 A | * | 8/1935 | Maccarone | A43B 9/06 36/17 R |
| 2,055,478 A | | 9/1936 | Brister | |

(Continued)

FOREIGN PATENT DOCUMENTS

WO 2018071301 A1 4/2018

*Primary Examiner* — Sharon M Prange

(74) *Attorney, Agent, or Firm* — Quinn IP Law

(57) ABSTRACT

An article of footwear and a method of manufacturing an article of footwear includes a strobel having a forefoot region, a midfoot region, and a heel region. The strobel may define a forefoot through hole in the forefoot region and a heel through hole in the heel region. The shape, the position, or both the shape and the position of the forefoot through hole and the heel through hole may be based on a foot pressure map. A method of manufacturing an article of footwear comprises securing a midsole to a strobel, wherein the strobel has a forefoot region, a midfoot region, and a heel region, the strobel defines a forefoot through hole in the forefoot region and a heel through hole in the heel region, and the shape and/or position of the forefoot through hole and the heel through hole are based on a foot pressure map.

11 Claims, 24 Drawing Sheets

(56) References Cited

U.S. PATENT DOCUMENTS

| | | | | |
|---|---|---|---|---|
| 3,345,663 | A * | 10/1967 | Batchelder | A43B 13/383 12/142 D |
| 3,406,468 | A * | 10/1968 | Pujol | A43B 7/1445 36/88 |
| 3,757,436 | A | 9/1973 | Winkler et al. | |
| 4,939,851 | A | 7/1990 | Miller | |
| 6,796,056 | B2 | 9/2004 | Swigart | |
| 7,559,158 | B2 | 7/2009 | Rosendahl | |
| 8,166,673 | B2 * | 5/2012 | Sills | A43B 1/0072 36/29 |
| 8,839,530 | B2 | 9/2014 | Smith et al. | |
| 9,445,649 | B2 * | 9/2016 | Huffa | A43B 13/38 |
| 2004/0261291 | A1 | 12/2004 | Paek | |
| 2007/0282562 | A1 | 12/2007 | Schwartz et al. | |
| 2012/0096745 | A1 | 4/2012 | Donato | |
| 2015/0257487 | A1 | 9/2015 | Ruiz et al. | |
| 2015/0371313 | A1 | 12/2015 | Xia et al. | |
| 2016/0219973 | A1 * | 8/2016 | Cheney | A43B 9/00 |
| 2016/0302517 | A1 | 10/2016 | Jessiman et al. | |
| 2017/0119091 | A1 | 5/2017 | Bischoff et al. | |
| 2017/0360153 | A1 | 12/2017 | Smith et al. | |
| 2018/0098601 | A1 * | 4/2018 | Hartenstein | A43B 7/141 |
| 2018/0103714 | A1 | 4/2018 | Howe | |
| 2018/0146748 | A1 | 5/2018 | Cornett | |
| 2018/0220741 | A1 | 8/2018 | Adami et al. | |

* cited by examiner

STROBEL FOR AN ARTICLE OF FOOTWEAR AND METHOD OF MANUFACTURING

CROSS-REFERENCE TO RELATED APPLICATION

This application claims the benefit of priority to U.S. Provisional Application No. 62/773,336, filed Nov. 30, 2018, which is hereby incorporated by reference in its entirety.

TECHNICAL FIELD

The present disclosure generally relates to an article of footwear having a strobel with a through hole and a method of manufacturing the article of footwear.

BACKGROUND

Footwear typically includes a sole structure configured to be located under a wearer's foot to space the foot away from the ground. Sole structures may typically be configured to provide one or more of cushioning, motion control, and resiliency.

BRIEF DESCRIPTION OF THE DRAWINGS

The drawings described herein are for illustrative purposes only, are schematic in nature, and are intended to be exemplary rather than to limit the scope of the disclosure.

DESCRIPTION

Figure 1:
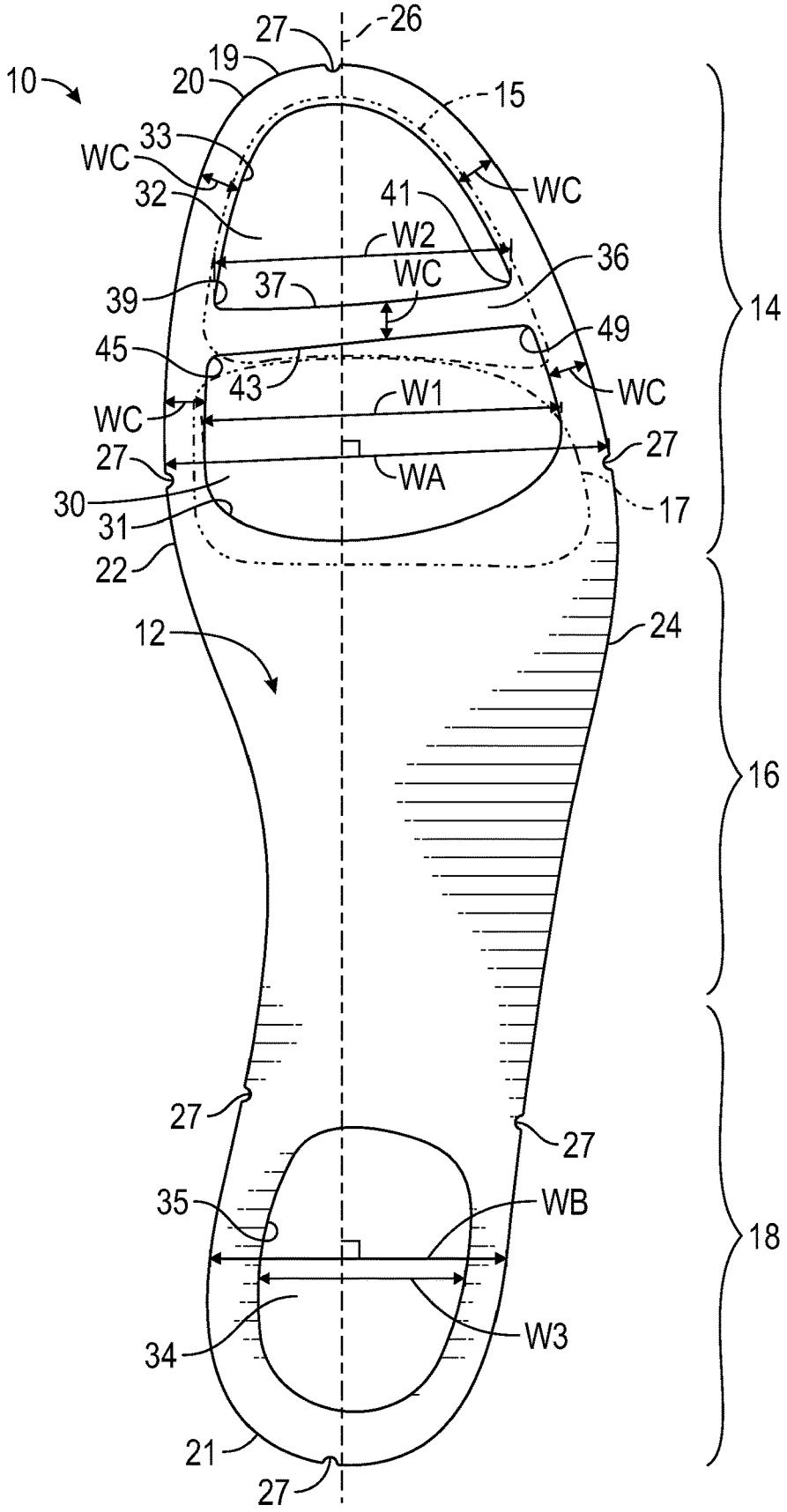
FIG. 1 is a top view of a strobel.

The present disclosure relates to an article of footwear and a method of manufacturing an article of footwear that includes a strobel that both enables lasting of the upper and enhances the ability of the cushioning and other performance properties of an underlying midsole to be transmitted directly to key loaded areas of a wearer's foot without interference, distortion or obstruction of the strobel. In an example, an article of footwear may comprise a strobel having a forefoot region, a midfoot region, and a heel region. The strobel may define a forefoot through hole in the forefoot region and a heel through hole in the heel region. The shape, the position, or both the shape and the position of the forefoot through hole and the heel through hole may be based on a foot pressure map.

In an example, the article of footwear may further comprise a midsole having a proximal surface secured to the strobel. The forefoot through hole and the heel through hole may span over the proximal surface of the midsole. The strobel, the proximal surface of the midsole at the forefoot through hole, and the proximal surface of the midsole at the heel through hole may together define a foot support surface. Stated differently, portions of the midsole underlying the forefoot through hole and the heel through hole form part of the foot support surface and the properties of the midsole are transmitted to the foot at these locations without the strobel intervening.

In one or more implementations, the article of footwear may further comprise an adhesive layer at which a distal surface of the strobel is adhered to the proximal surface of the midsole. Moreover, in one or more configurations, the adhesive layer does not extend across the proximal surface of the midsole at the forefoot through hole or at the heel through hole. Accordingly, an underlying midsole is not encumbered by the adhesive at the through holes, and the adhesive does not affect the transmission of properties of the midsole to a wearer's foot.

In one or more configurations, an edge of the strobel surrounding the through hole in the forefoot region and an edge of the strobel surrounding the through hole in the heel region may be defined by perforation. For example, the strobel may first be perforated, and then portions of the strobel may be removed at the perforations to define the through holes. In some configurations, the strobel may be a recyclable material. Any portions of the strobel removed at the through holes can then be recycled.

In a further aspect of the disclosure, the through holes may be positioned to align with certain portions of a wearer's foot that bear relatively high loads, such as the metatarsal heads and the heel. For example, the forefoot region may encompass a phalangeal region and a metatarsal head region, with the phalangeal region between a forward edge of the strobel and the metatarsal head region, and the metatarsal head region between the phalangeal region and the midfoot region. The forefoot through hole may be in the metatarsal head region. In an embodiment, this forefoot through hole is a first forefoot through hole, and the strobel also defines a second forefoot through hole that may be substantially in the phalangeal region. When the through holes are of a substantial width, the relatively stiff material of the strobel has less affect on the cushioning and flexibility of the article of footwear at the through hole, and a greater amount of an underlying midsole can define the foot support surface. For example, the first forefoot through hole may be surrounded by the strobel, and may have a maximum width greater than 50 percent of a maximum width of the strobel in the metatarsal head region. In addition, the second forefoot through hole may have a maximum width greater than 50 percent of a maximum width of the strobel in the phalangeal region.

In one or more implementations, a rear edge of the second forefoot through hole may be straight between a rounded medial corner and a rounded lateral corner of the second forefoot through hole. A front edge of the first forefoot through hole may also be straight between a rounded forward medial corner and a rounded forward lateral corner of the first forefoot through hole. A rear edge of the first forefoot through hole may be straight between a rounded rear medial corner and a rounded rear lateral corner of the first forefoot through hole.

In an example, a width of the strobel bounding lateral and medial sides of the first forefoot through hole and bounding lateral and medial sides of the second forefoot through hole is constant. As used herein, a width is "constant" if it varies by not more than 5 percent, not considering variations in width at locating features.

In one or more configurations, in additional to the first forefoot through hole, the strobel may define a plurality of additional forefoot through holes substantially in the phalangeal region. For example, the additional forefoot through holes may each be relatively small, but their number and proximity to one another may increase the flexibility of the strobel and minimize any interference that it may have on the transmission of properties of the underlying sole structure in the phalangeal region. In one or more implementations, the additional forefoot through holes may each have a width in a transverse direction of the strobel greater than a length in a longitudinal direction of the strobel. Accordingly, the through holes are elongated in the transverse direction. Similarly, the heel through hole described above may be a first heel through hole, and the strobel may define a plurality of additional heel through holes substantially in the heel region between the first heel through hole and the midfoot region. The plurality of additional heel through holes may be surrounded by the strobel. As with the additional forefoot through holes, the additional heel through holes may each be relatively small, but their number and proximity to one another may increase the flexibility of the strobel and minimize any interference that it may have on the transmission of properties of the underlying sole structure in the heel region. In one or more implementations, the additional heel through holes each have a width in a transverse direction of the strobel greater than a length in a longitudinal direction of the strobel.

In one or more configurations, the heel through hole may have a maximum width greater than 50 percent of a maximum width of the strobel in the heel region. A front edge of the heel through hole may be straight between a rounded forward medial corner and a rounded forward lateral corner of the heel through hole.

In one or more implementations of the disclosure, the article of footwear may further comprise an upper secured to an outer periphery of the strobel and defining a foot-receiving cavity over the strobel. Because the strobel may surround the through holes, the outer periphery is outward of the through holes, and the upper helps to locate the foot in the foot-receiving cavity over the strobel so that the portions of the foot align with and are supported on the foot support surface as intended, with the metatarsal heads disposed at the forefoot through hole and the heel disposed at the heel through hole.

In an aspect of the disclosure, an article of footwear comprises a strobel having a forefoot region, a midfoot region, and a heel region. The strobel may define a forefoot through hole in the forefoot region. The forefoot through hole may have a maximum width greater than 50 percent of a maximum width of the strobel in the forefoot region. A front edge of the forefoot through hole may be straight between a rounded front medial corner and a rounded front lateral corner of the forefoot through hole. A rear edge of the forefoot through hole may be straight between a rounded rear medial corner and a rounded rear lateral corner of the first forefoot through hole. The shape, the position, or both the shape and the position of the forefoot through hole may be based on a foot pressure map. Additionally, a width of the strobel bounding lateral and medial sides of the forefoot through hole may be constant. In an aspect of the disclosure, the strobel may include at least one of an additional forefoot through hole having a width greater than 50 percent of a width of the strobel in the forefoot region, and a heel through hole having a width greater than 50 percent of a width of the strobel in the heel region.

In an aspect of the disclosure, a method of manufacturing an article of footwear may comprise securing a midsole to a strobel. The strobel may have a forefoot region, a midfoot region, and a heel region. The strobel may define a forefoot through hole in the forefoot region and a heel through hole in the heel region. The shape and/or position of the forefoot through hole and the heel through hole may be based on a foot pressure map.

In one or more configurations, the method may further comprise securing the strobel to an upper to define a foot-receiving cavity prior to securing the midsole to the strobel. Still further, the method may comprise placing the strobel and the upper on a last by inserting the last in the foot-receiving cavity.

In an aspect, the method may comprise disposing an adhesive on a distal surface of the strobel, or on a proximal surface of the midsole, or on both the distal surface of the strobel and the proximal surface of the midsole. Securing the midsole to the strobel may be by positioning the proximal surface of the midsole adjacent to the distal surface of the strobel to adhere the midsole to the strobel with the adhesive.

In one or more configurations, adhesive may be disposed on the distal surface of the strobel without extending across the forefoot through hole and the heel through hole. Furthermore, the method may include perforating the strobel to define perforations in the forefoot region and perforations in the heel region prior to disposing the adhesive on the distal surface of the strobel. The method may further include removing a portion of the strobel at the perforations in the forefoot region to define the forefoot through hole, and removing a portion of the strobel at the perforations in the heel region to define the heel through hole. Disposing the adhesive on the distal surface of the strobel may be prior to removing the portion of the strobel at the perforations in the forefoot region, and before removing the portion of the strobel at the perforations in the heel region. In addition, the method may further comprise recycling the portion of the strobel removed at the perforations in the forefoot region and the portion of the strobel removed at the perforations in the heel region.

The above features and advantages and other features and advantages of the present teachings are readily apparent from the following detailed description of the modes for carrying out the present teachings when taken in connection with the accompanying drawings.

Referring to FIG. 1, a strobel 10 for an article of footwear is shown. The foot support surface 12 of the strobel 10 is shown. The strobel 10 includes a forefoot region 14, a midfoot region 16, and a heel region 18. As such the strobel 10 is configured to extend below the length of a foot supported thereon, and may be referred to as a full-length strobel. The forefoot region 14 generally includes portions of the strobel 10 corresponding with the toes and the metatarsophalangeal joints (which may be referred to as MPT or MPJ joints) connecting the metatarsal bones of the foot and the proximal phalanges of the toes. The forefoot region 14 can thus be divided into a phalangeal region 15 and a metatarsal head region 17. The phalangeal region 15 generally corresponds with the phalanges, including distal, middle, and proximal phalanxes, and the metatarsal head region 17 generally corresponds with the metatarsal bones and the MPJ joints. The phalangeal region 15 is between the forward edge 19 of the strobel 10 and the metatarsal head region 17, and the metatarsal head region 17 is between the phalangeal region 15 and the midfoot region 16.

The midfoot region 16 generally includes portions of the strobel 10 corresponding with the arch area and instep of the foot, and the heel region 18 corresponds with rear portions of the foot, including the calcaneus bone. The forefoot region 14, the midfoot region 16, and the heel region 18 are not intended to demarcate precise areas of the strobel 10, but are instead intended to represent general areas of the strobel 10 to aid in the following discussion.

The strobel 10 has an outer edge 20 extending completely around the strobel 10 and defining the outer perimeter of the strobel 10. The outer edge 20 includes a portion referred to as a medial side edge 22 and a portion referred to as a lateral side edge 24. The medial side edge 22 and the lateral side edge 24 extend through each of the forefoot region 14, the midfoot region 16, and the heel region 18, and correspond with opposite sides of the strobel 10, each falling on an opposite side of a longitudinal midline 26 of the strobel 10. The medial side edge 22 is thus considered opposite to the lateral side edge 24. The outer edge 20 also includes a portion referred to as a forward edge 19 and a portion referred to as a rear edge 21. Locating features 27 such as notches are disposed about the outer edge 20 and are used in precisely positioning the strobel 10 relative to an upper when securing the strobel 10 to the upper and/or in precisely positioning the strobel 10 on a last.

The strobel 10 may be comprised of one or more of a variety of materials that are relatively inelastic in order to serve its function of closing the bottom of an upper when the upper is lasted and precisely locating the upper on the last. For example, if the strobel 10 is elastic, it is more apt to vary in location once placed on the last. However, relatively inelastic material used for a strobel could have the drawback of diminishing the ability of cushioning and compression characteristics of an underlying sole structure, including a midsole, to be relayed to and felt by the foot.

In part to overcome these potential disadvantages of a strobel, the strobel 10 represents a departure from traditional strobel designs by including multiple through holes 30, 32, 34, each of which is extends entirely through the strobel 10 from the foot support surface 12 to an opposite distal surface. The strobel 10 defines a first forefoot through hole 30 and a second forefoot through hole 32 in the forefoot region 14, and a heel through hole 34 in the heel region 18. The through holes 30, 32, 34 are entirely surrounded by the strobel 10. Stated differently, the first forefoot through hole 30 has a closed shape with an outer boundary defined by an edge 31 of the strobel 10. The second forefoot through hole 32 has a closed shape with an outer boundary defined by an edge 33 of the strobel 10. The heel through hole 34 has a closed shape with an outer boundary defined by an edge 35 of the strobel 10. By configuring the through holes 30, 32, 34 as closed shapes, the continuous outer edge 20 of the strobel 10 is not broken by any intersection with the through holes, and may have the advantage of easy securement to an upper, such as by sewing around the continuous edge. The through holes 30, 32, 34 may be defined by laser cutting the strobel 10, molding the strobel 10 with the through holes 30, 32, 34, or by removing portions of the strobel 10 at perforations as described herein. Any portions removed may be recycled as described herein.

The first forefoot through hole 30 is substantially in the metatarsal head region 17, and the second forefoot through hole 32 is substantially in the phalangeal region 15. A strip 36 of the strobel 10 extends between and separates the first and second through holes 30, 32. The strobel extends continuously from the medial side edge 22 to the lateral side edge 24 at the strip 36. Because of the strip 36, the width of the relatively inelastic strobel 10 is maintained at and restrained by the strip 36 during the lasting process.

The through holes are relatively wide in order to expose a substantial portion of an underlying midsole to a foot. For example, the first forefoot through hole 30 may have a maximum width W1 greater than 50 percent of a maximum width WA of the strobel 10 in the forefoot region 14. For purposes of this comparison, the widths are measured perpendicular to the longitudinal midline 26. The second forefoot through hole 32 may also have a width W2 greater than 50 percent of the maximum width WA of the strobel 10 in the forefoot region 14. The heel through hole 34 is of a maximum width W3 greater than 50 percent of a maximum width WB of the strobel 10 in the heel region 18. When the through holes 30, 32, 34 are of such a substantial width, the relatively stiff material of the strobel 10 has less affect on the cushioning and flexibility of the article of footwear at the through hole, and a greater amount of an underlying midsole can define the foot support surface.

The second forefoot through-hole 32 has a rear edge 37 that is straight between a rounded medial corner 39 and a rounded lateral corner 41 of the second forefoot through hole 32. A front edge 43 of the first forefoot through hole 30 is straight between a rounded forward medial corner 45 and a rounded forward lateral corner 49 of the first forefoot through hole 30. Additionally, a width of the strobel WC bounding lateral and medial sides of the first forefoot through hole 30 and bounding lateral and medial sides of the second forefoot through hole 32 is constant. The width of the strip 36 may also be the same width WC as the portion of the strobel 10 bounding the first and second forefoot through-holes 30, 32 on the medial and lateral sides. The width WC is measured perpendicular to the edges 22 and 31 or 33, and perpendicular to the edges 24 and 31 or 33, and does not include variations due to locating features 27. The width WC of the strip 36 is measured perpendicular to the edges 31, 33. As used herein, the width WC is "constant" as it varies by not more than 5 percent, not considering variations in width at locating features.

Figure 2:
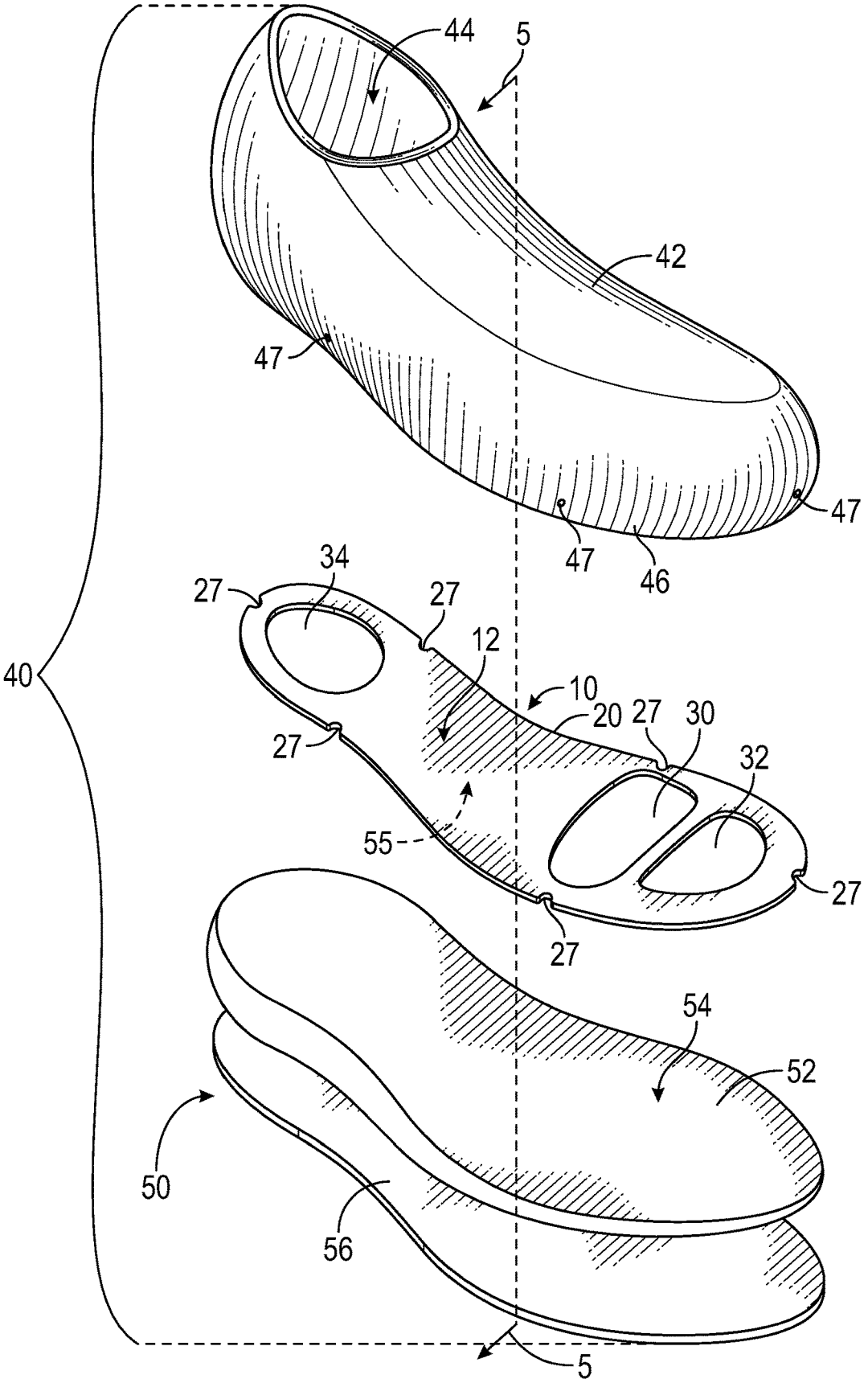
FIG. 2 is an exploded perspective view of an article of footwear including the strobel of FIG. 1.

FIG. 2 shows an article of footwear 40 in exploded view. The article of footwear 40 includes the strobel 10 of FIG. 1. The article of footwear 40 may include an upper 42 configured to be secured at a lower extent 46 to a periphery of the strobel 10 around the continuous outer edge 20 so that the strobel 10 closes an opened lower end of the upper 42, the upper 42 and the strobel 10 together defining a void that serves as a foot-receiving cavity 44 configured to receive a foot. The upper 42 may have locating features 47 such as markings or openings that are spaced apart from one another correspondingly with the spacing of the locating features 27 of the strobel 10 so that they can be aligned with the locating features 27 to help align the upper 42 with the strobel 10 prior to securement. The upper 42 may be a variety of materials, such as leather, textiles, polymers, cotton, foam, composites, etc. For example, the upper 42 may be a polymeric material capable of providing elasticity, and may be of a braided construction, a knitted (e.g., warp-knitted) construction, or a woven construction. An insole (not shown) may rest in the foot-receiving cavity 44 on the foot support surface 12. The upper 42 may be tightenable around the foot to help locate the foot over the strobel and align the through holes 30, 32, 34 with the intended portions of the foot as discussed herein.

The article of footwear 40 may also include a sole structure 50 that includes a midsole 52 having a proximal surface 54 secured to a distal surface 55 of the strobel 10 at least in part by adhesive (not shown in FIG. 2). The forefoot through holes 30, 32 and the heel through hole 34 may span over the proximal surface 54 of the midsole 52. Due to the through holes 30, 32, 34, portions of the midsole 52 underlying the forefoot through holes 30, 32 and the heel through hole 34 form part of the foot support surface along with the foot support surface 12 of the strobel 10, and the properties of the midsole 52 are transmitted to the foot at these locations without the strobel 10 intervening.

The midsole 52 may be formed from a compressible polymer foam element (e.g., a polyurethane or ethylvinylacetate foam) that attenuates ground reaction forces (e.g., provides cushioning) when compressed between a foot and the ground during walking, running, or other ambulatory activities. In further configurations, the midsole 52 may incorporate fluid-filled chambers, plates, moderators, or other elements that further attenuate forces, enhance stability, or influence the motions of the foot. The midsole 52 may be a single, one-piece midsole, or could be multiple components integrated as a unit. The sole structure 50 may include an outsole 56 that could be one-piece, or may be several outsole components, and may be formed from a variety of materials, such as but not limited to wear-resistant rubber material that may be textured to impart traction, and/or may include traction elements such as cleats secured to the midsole 52. In some embodiments, the midsole 52 may be integrated with the outsole 56 as a unisole.

Figure 3:
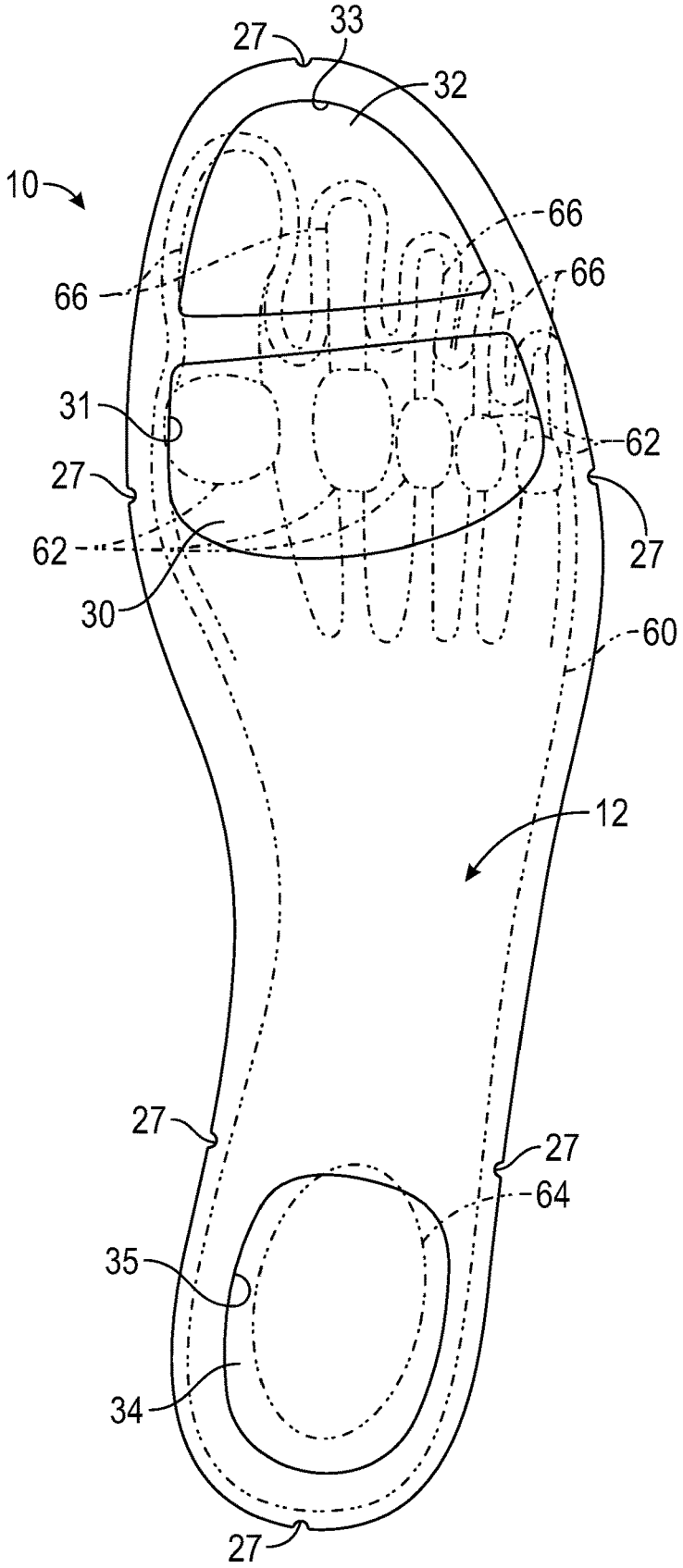
FIG. 3 is a top view of the strobel of FIG. 1 with a foot shown in phantom resting on the strobel.

Referring to FIG. 3, a foot 60 is shown in phantom resting on the strobel 10 in the position it will be in when inserted into the article of footwear 40. The foot 60 may be representative of an average foot of the standard shoe size (e.g., United States shoe size scale) for which the strobel 10 and article of footwear 40 is intended. For example, the configuration of the representative foot 60 may be based on averages of measurement data of a portion of the population. Alternatively, the foot 60 may be based on measurements of a particular wearer for which the strobel 10 and the article of footwear 40 is custom fit. In either case, the through holes 30, 32, 34 may be positioned to align with certain portions of the wearer's foot 60 that bear relatively high loads, such as the metatarsal heads 62, the phalanges 66, and the heel at the calcaneus bone 64. The metatarsal heads 62 are disposed directly over the first forefoot through hole 30, and the calcaneus bone 64 is disposed directly over the heel through hole 34. Phalanges 66 are disposed substantially over the second forefoot through hole 32.

Figure 4:
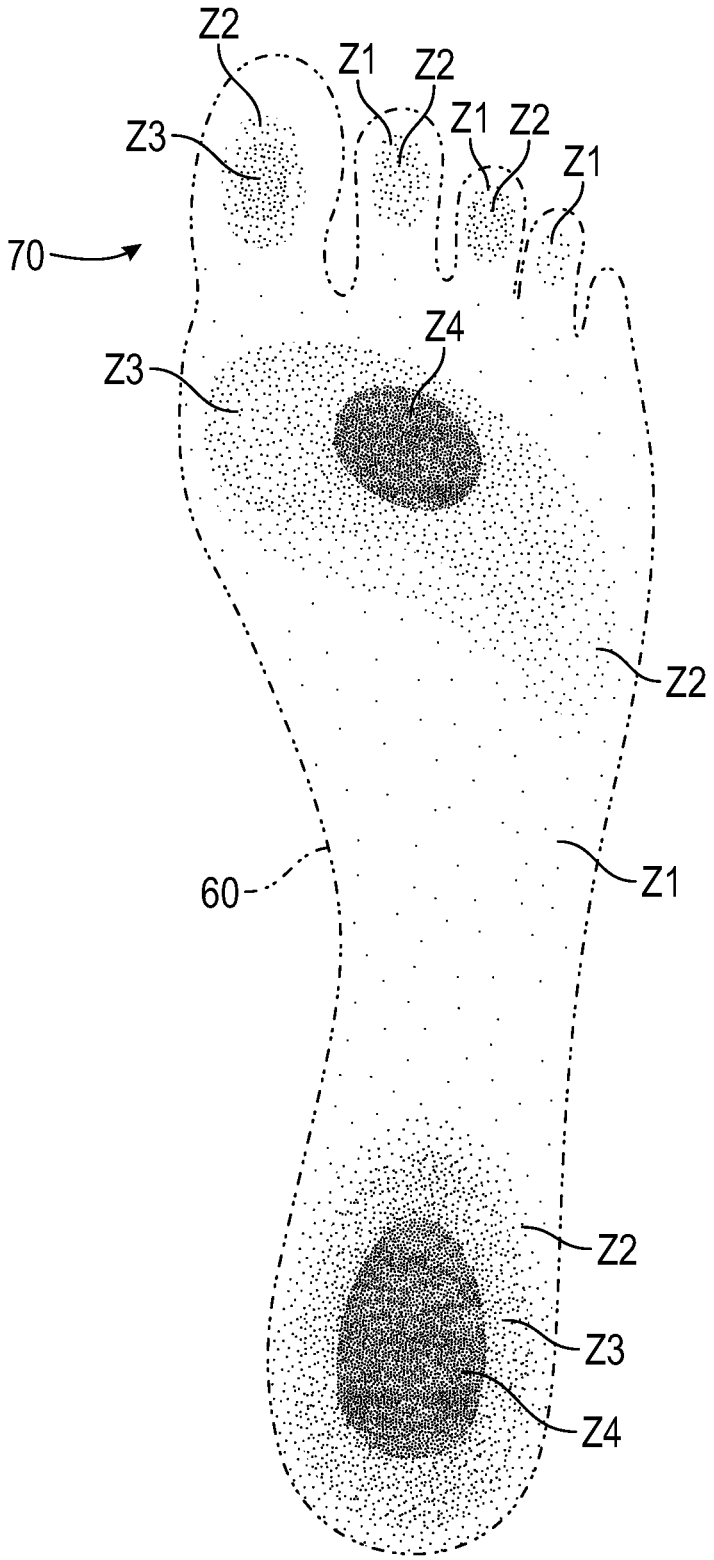
FIG. 4 is an illustration of a foot pressure map corresponding with the foot of FIG. 3.

FIG. 4 shows a pressure map 70 of the foot 60. The outer boundary of the foot 60 is indicated in phantom, and the relative pressures exerted on the foot 60 are indicated by a density of shading as a pressure map 70. The pressure map 70 is based on a measurement of pressures distributed over the foot 60 during stationary or ambulatory activities, and may be representative of a population average, or of an individual customer for which the strobel 10 and article of footwear 40 are customized. A pressure monitoring system may be used to collect the data. For illustrative purposes, the relative magnitudes of the pressures of loads on the foot are indicated by the density of shading. More dense shading corresponds to relatively higher pressures. The pressures are divided into ranges, and are indicated as pressure zones Z1, Z2, Z3 and Z4. One or more first zones indicated as Z1 cover the areas of the foot 60 that experienced a first, highest range of pressures during the measurement. One or more second zones indicated as Z2 cover areas of the foot 60 that experienced pressures in a second range of pressures higher than the first range during the measurement. One or more third zones indicated as Z3 cover areas that experienced pressure in a third range of pressures higher than the second range during the measurement. Zone Z4 covers areas that experienced pressure in a fourth range of pressures higher than the third range. When FIG. 4 is viewed in conjunction with FIG. 3, it is evident that the through holes 30, 32, 34 generally correspond with the higher pressure zones Z2-Z4, and the higher pressure zones Z2-Z4 generally correspond with loading by the metatarsal heads 62, the calcaneus bone 64 of the heel, and the phalanges 66. Moreover, the through holes 30 and 34 are substantially centered over the zone with the highest range of pressures, zone Z4.

Figure 5:
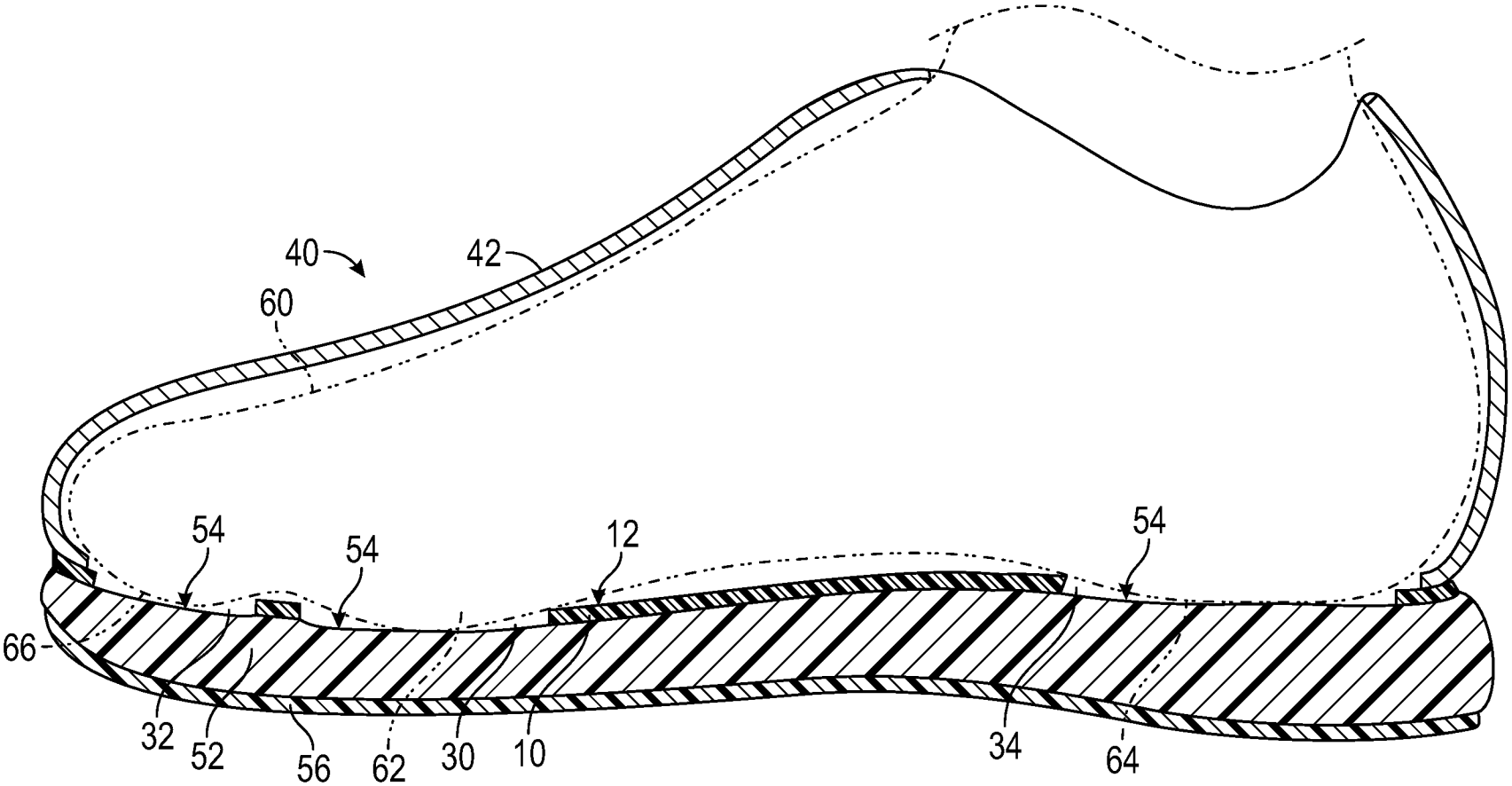
FIG. 5 is a cross-sectional view of the article of footwear of FIG. 2 taken at lines 5-5 in FIG. 2.

FIG. 5 shows the foot 60 supported on the strobel 10, with the metatarsal heads 62 extending over the first forefoot through hole 30 and supported on the midsole 52 without the strobel 10 between the metatarsal heads 62 and the midsole 52. The phalanges 66 extend over the second forefoot through hole 32 and are supported on the midsole 52 without the strobel 10 between the phalanges 66 and the midsole 52. The calcaneus bone 64 of the heel extends over the heel through hole 34 and is supported on the midsole 52 without the strobel between the calcaneus bone 64 and the midsole 52. Therefore, in addition to portions of the foot resting on the foot support surface 12 of the strobel 10, portions of the foot 60 with the highest pressure loading rest directly on the proximal surface 54 of the midsole 52. These portions of the foot 60 are subjected more directly to the resilient cushioning of the midsole 52, without the inelastic strobel 10 intervening and potentially altering the affect of the midsole cushioning.

Figure 6:
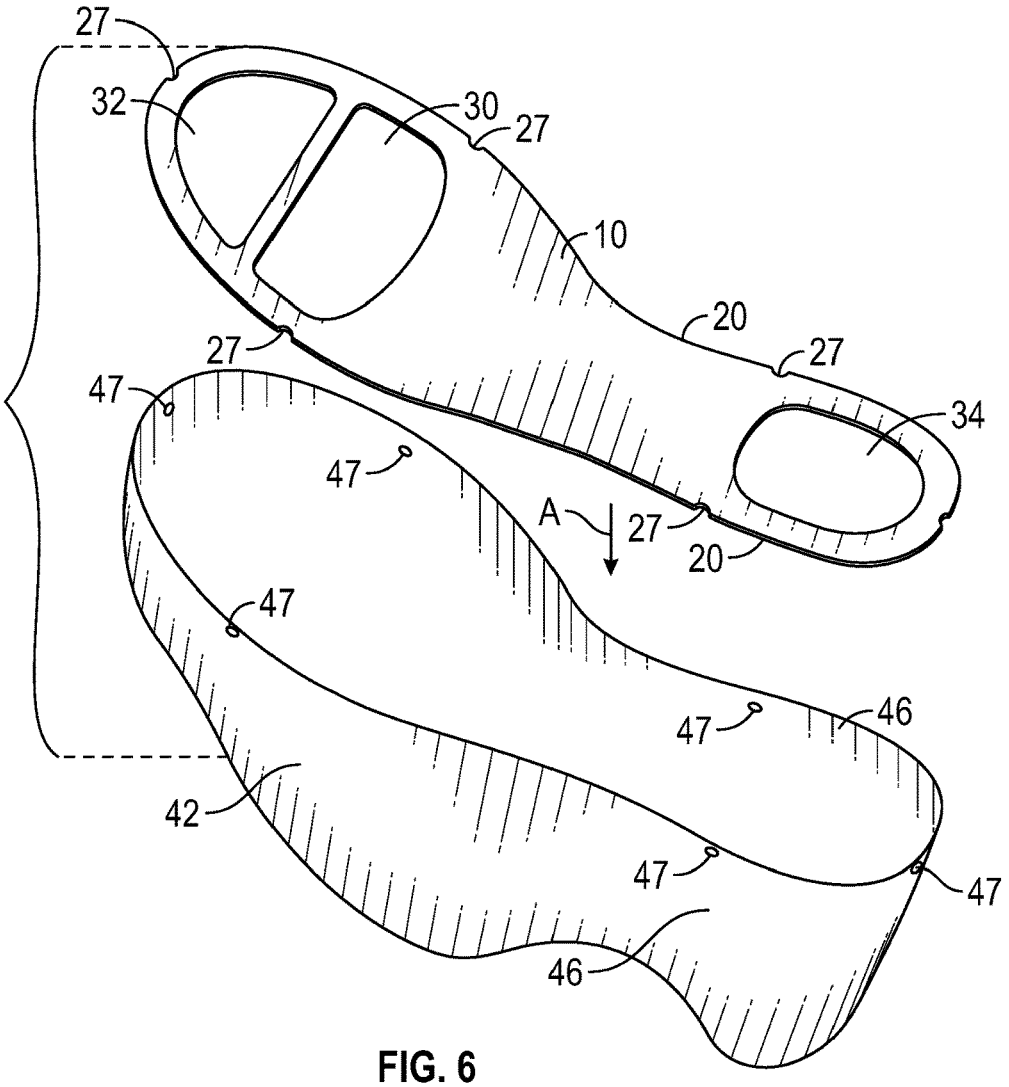
FIG. 6 is a perspective view of the strobel of FIG. 1 aligned for stitching to an upper.
Figure 7:
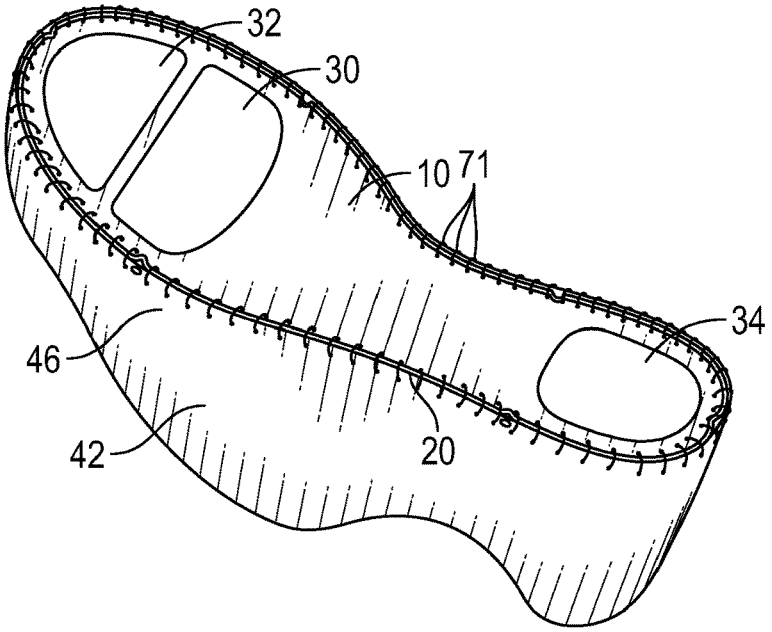
FIG. 7 is a perspective view of the strobel and upper of FIG. 6, with the strobel stitched to the upper.

Referring to FIG. 6, the strobel 10 and upper 42 may be placed adjacent one another, as indicated by the arrow A, with the strobel 10 at the open lower end of the upper 42, and locating features 27 (e.g., notches) of the strobel 10 may be aligned with locating features 47 (e.g., apertures or markings) of the upper 42. Next, as shown in FIG. 7, the strobel 10 may be secured to the lower extent 46 of the upper 42 to define the foot-receiving cavity 44. Securing the strobel 10 to the upper 42 may be by stitching the lower extent 46 to a periphery of the strobel 10 around the continuous outer edge 20 as shown by a series of stitches 71. Other modes of securing the strobel 10 to the upper 42 may include adhesives or thermal bonding.

Figure 8:
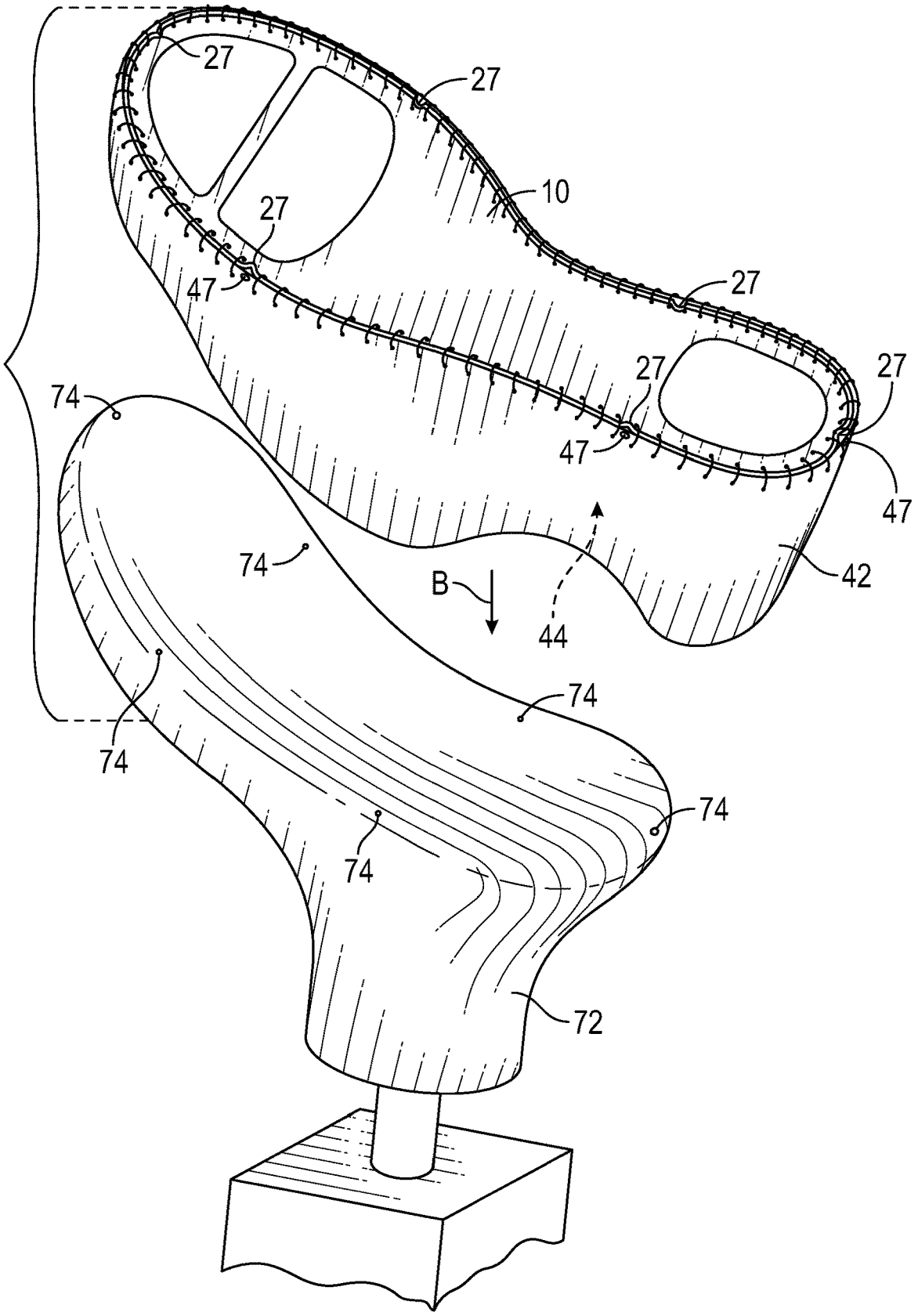
FIG. 8 is a perspective view of the strobel and upper of FIG. 6 being moved toward placement on a last.

In FIG. 8, the strobel 10 and the upper 42 secured thereto are placed on a last 72 by inserting the last 72 into the foot-receiving cavity 44. This may be accomplished by moving the strobel 10 and upper 42 toward the last 72 as shown by arrow B. The toe end of the last 72 may need to be inserted into first through an ankle opening into the foot-receiving cavity 44. The upper 42 may need to be tightened around the last 72 if it includes laces or another tightening system. The last 72 may have locating features 74 such as markings that are spaced apart from one another with the same spacing as the locating features 27 and 47 to aid in properly positioning the strobel 10 and upper 42 on the last 72.

Figure 9:
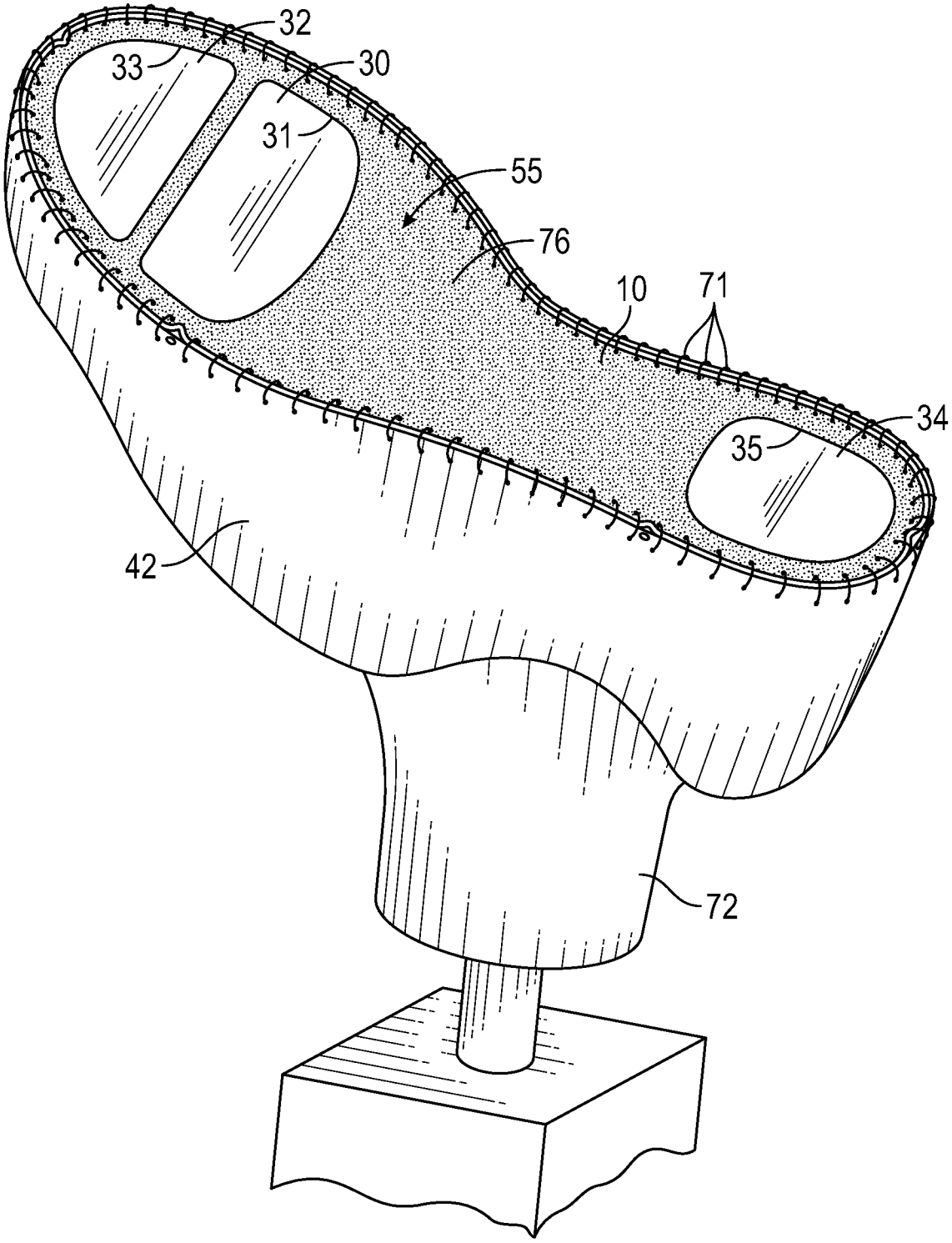
FIG. 9 is a perspective view of the lasted upper and strobel of FIG. 8 with adhesive placed on a distal surface of the strobel.

Referring to FIG. 9, in preparation for securing the midsole 52 to the strobel 10, an adhesive 76, also referred to as an adhesive layer, is disposed on the distal surface 55 of the strobel 10. The adhesive 76 is represented by dot shading in FIG. 9. As shown in FIG. 9, the adhesive 76 may be disposed on the distal surface 55 of the strobel 10 without extending across the forefoot through holes 30, 32 and the heel through hole 34 so that it is not disposed on the last 72. In another aspect, the adhesive 76 could instead by disposed on the proximal surface 54 of the midsole 52, or on both the distal surface 55 of the strobel 10 and the proximal surface 54 of the midsole 52.

Figure 10:
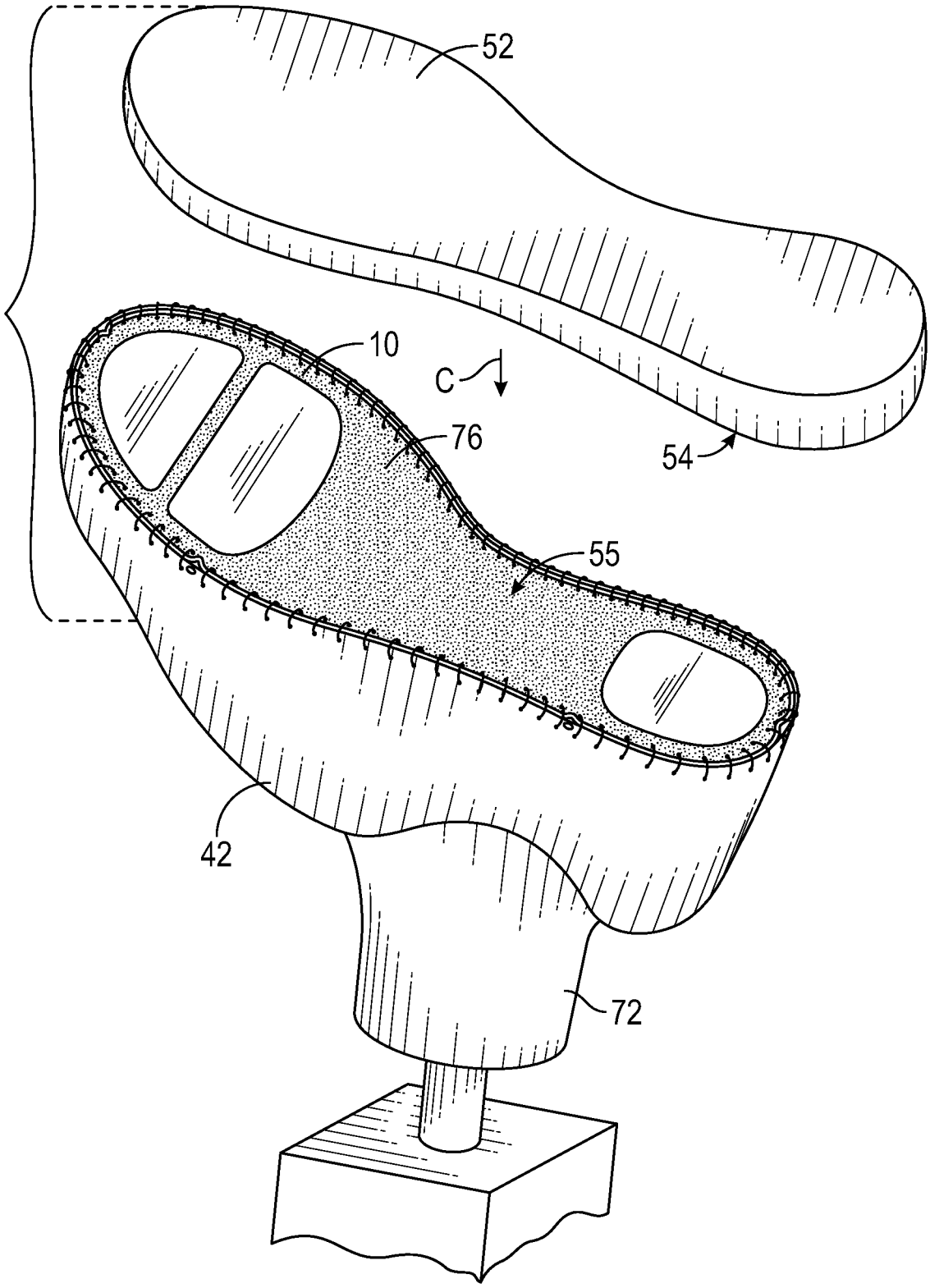
FIG. 10 is a perspective view of the lasted upper and strobel of FIG. 9 with a midsole being moved toward placement against the adhesive on the distal surface of the strobel.

FIG. 10 shows the midsole 52 being moved toward the strobel 10 as indicated by arrow C to position the proximal surface 54 of the midsole 52 adjacent to the distal surface 55 of the strobel 10. Once in contact with one another, the midsole 52 is secured to the strobel 10 by adhering the midsole to the strobel with the adhesive 76. The midsole 52 may be kept in this position for a predetermined amount of time deemed necessary for the adhesive 76 to cure. In some embodiments, the midsole 52 may be in a heated state that causes it to thermally bond to the strobel 10 and upper 42, in which case the use of adhesive may be reduced or avoided. The outsole 56 is not shown in FIG. 10, but may be secured to the midsole 52 before the midsole 52 is secured to the strobel 10. For example, the outsole 56 may be co-molded with the midsole 52 or may be adhered to the midsole 52. In some embodiments, the outsole 56 may be secured to the midsole 52 after the midsole 52 is secured to the strobel 10.

Figure 11:
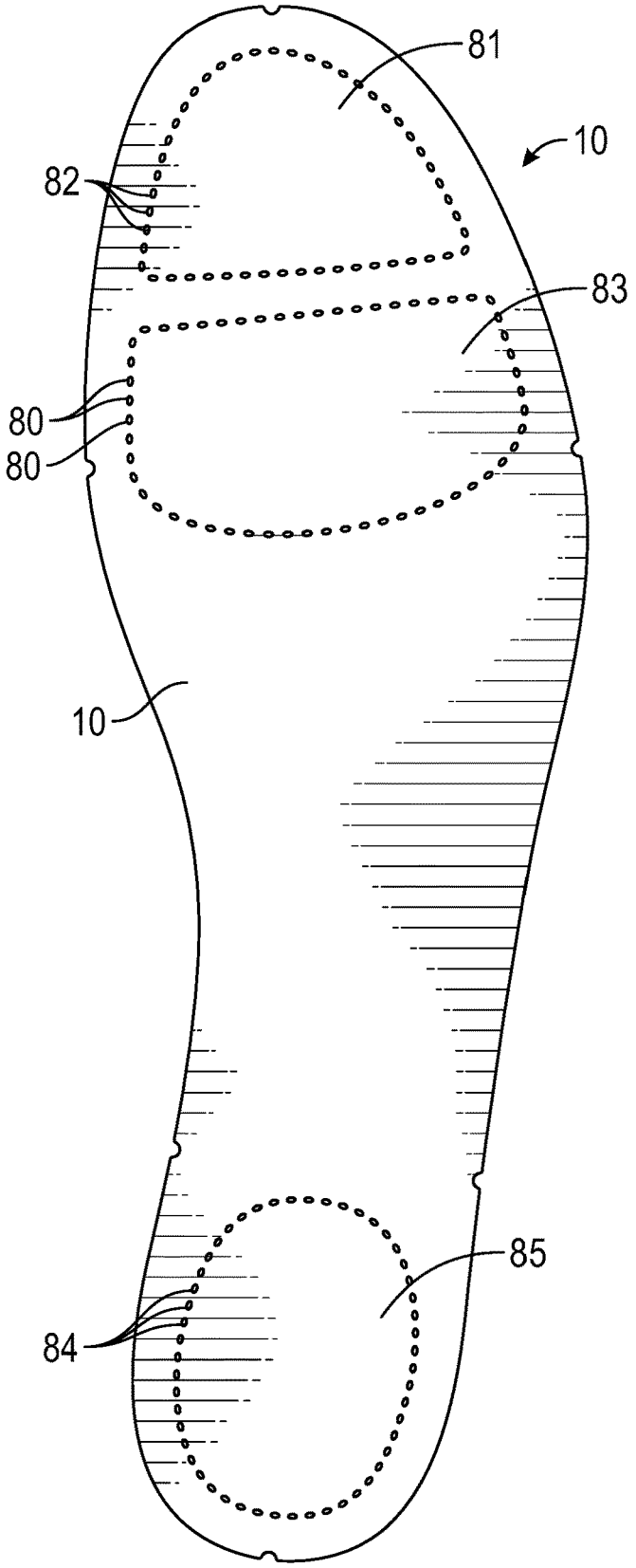
FIG. 11 is a top view of a strobel in accordance with another aspect of the disclosure.

FIG. 11 shows an embodiment of the strobel 10 in which the strobel 10 is perforated at perforations 80, 82, and 84 (only some of which are labelled). The perforations 80, 82, 84 are arranged in the shape of the through holes 30, 32, 34, respectively so that when portions 81, 83, 85 of the strobel 10 are removed at the perforations 80, 82, 84, the through holes 30, 32, 34 are established, and the edges 31, 33, 35 of the strobel 10 are defined by the perforations 80, 82, 84 (see FIG. 16).

Figure 12:
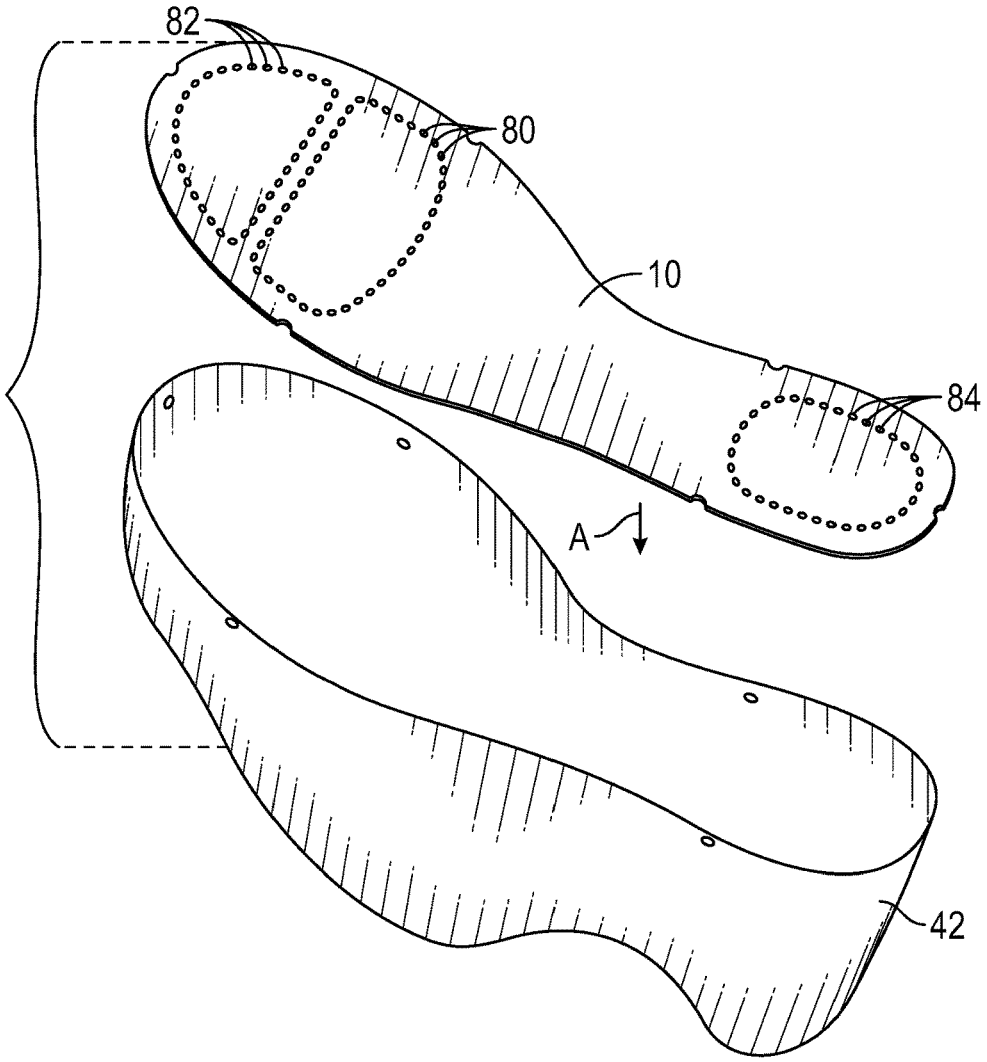
FIG. 12 is a perspective view of the strobel of FIG. 11 aligned for stitching to an upper.
Figure 13:
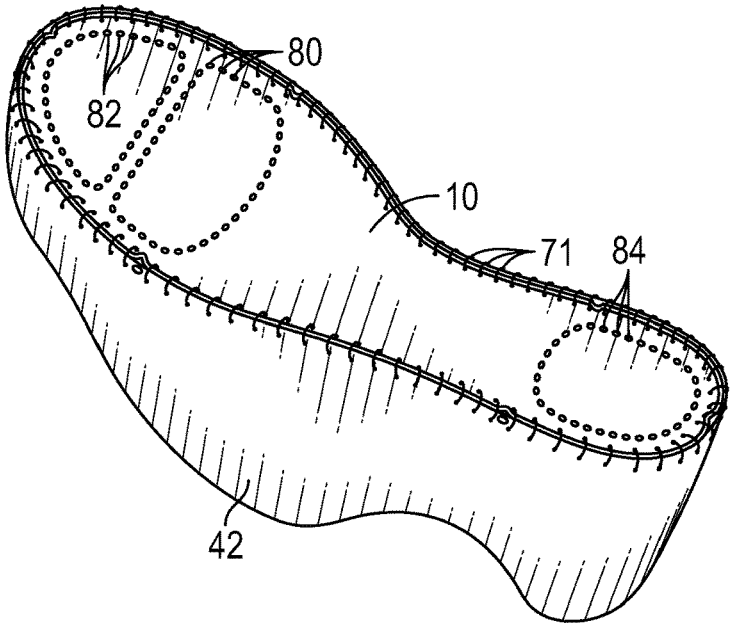
FIG. 13 is a perspective view of the strobel and upper of FIG. 12, with the strobel stitched to the upper.
Figure 14:
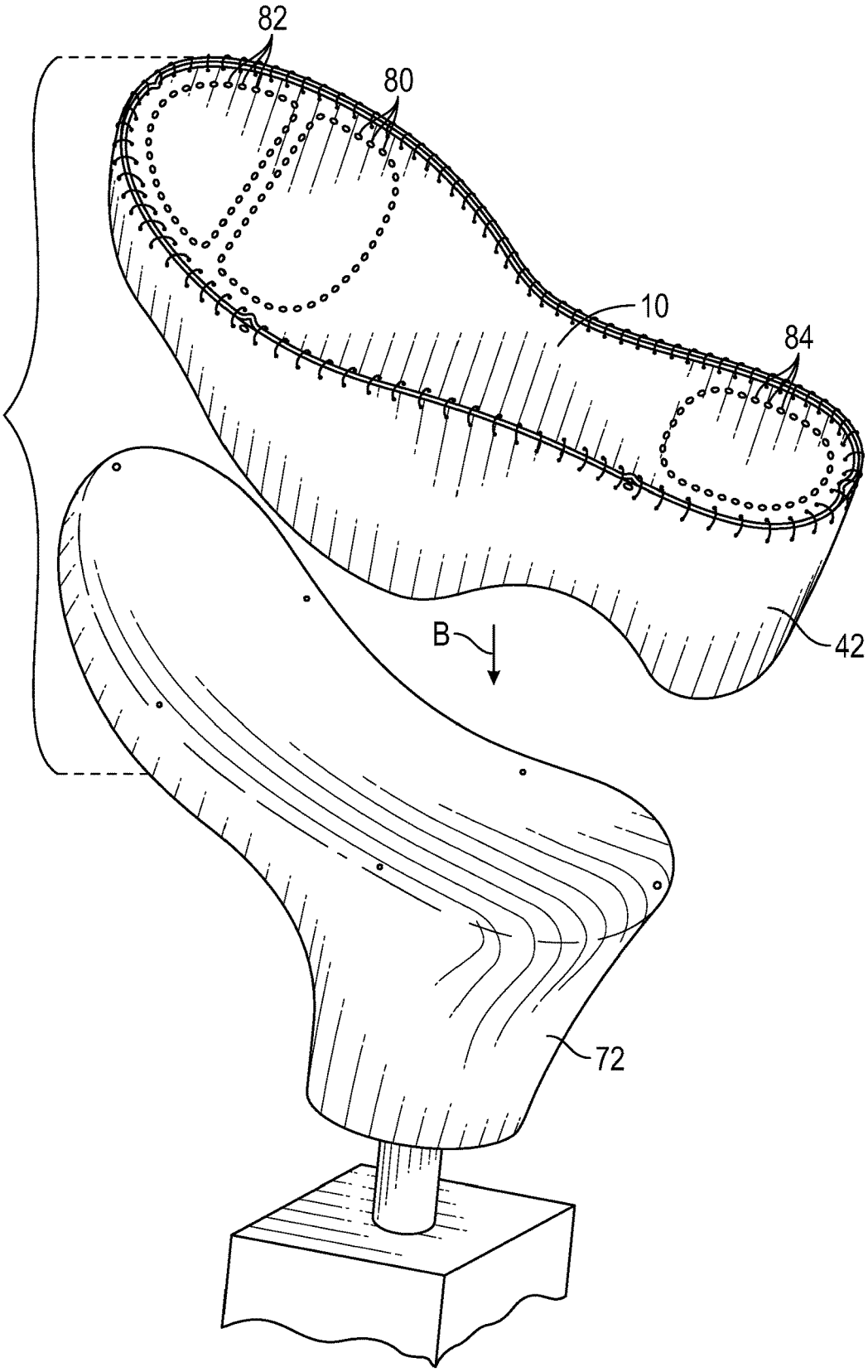
FIG. 14 is a perspective view of the strobel and upper of FIG. 13 being moved toward placement on a last.

In FIG. 12, the perforated strobel 10 is shown being positioned at the open end of the upper 42 as described in FIG. 6. In FIG. 13, the strobel 10 is shown being secured to the upper 42 by stitching as described in FIG. 7. In FIG. 14, the strobel 10 with the upper 42 secured thereto is shown being placed on the last 72 as described in FIG. 8.

Figure 15:
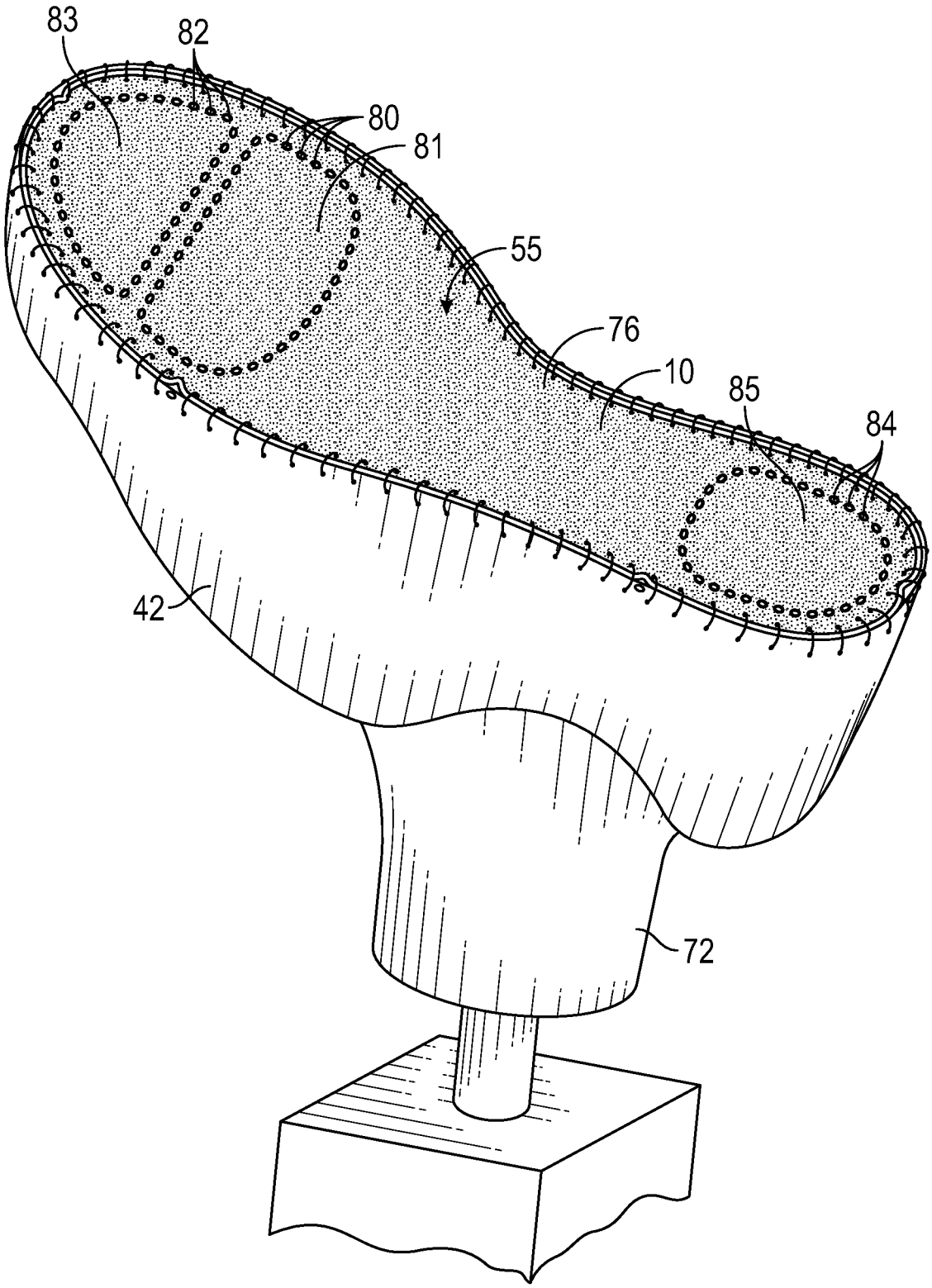
FIG. 15 is a perspective view of the lasted upper and strobel of FIG. 14 with adhesive placed on a distal surface of the strobel.

Referring to FIG. 15, after the strobel 10 with the upper 42 secured thereto are on the last 72, the adhesive 76 is disposed on the distal surface 55 of the strobel 10, including across the perforations 80, 82, 84, and the portions 81, 83, 85 surrounded by the perforations 80, 82, 84. The through holes 30, 32, 34 are not yet in existence (because the portions 81, 83, 85 are not yet removed), and disposing the adhesive 76 across the portions 81, 83, 85 that will later be removed to define the through holes 30, 32, 34 may be easier than disposing the adhesive 76 carefully around (i.e., without extending across) the through holes 30, 32, 34 as in FIG. 9. For example, the adhesive 76 may be disposed with a roller by rolling across the entire distal surface 55 of the strobel 10, including those portions 81, 83, 85 surrounded by the perforations 80, 82, 84. This may reduce manufacturing time.

Figure 16:
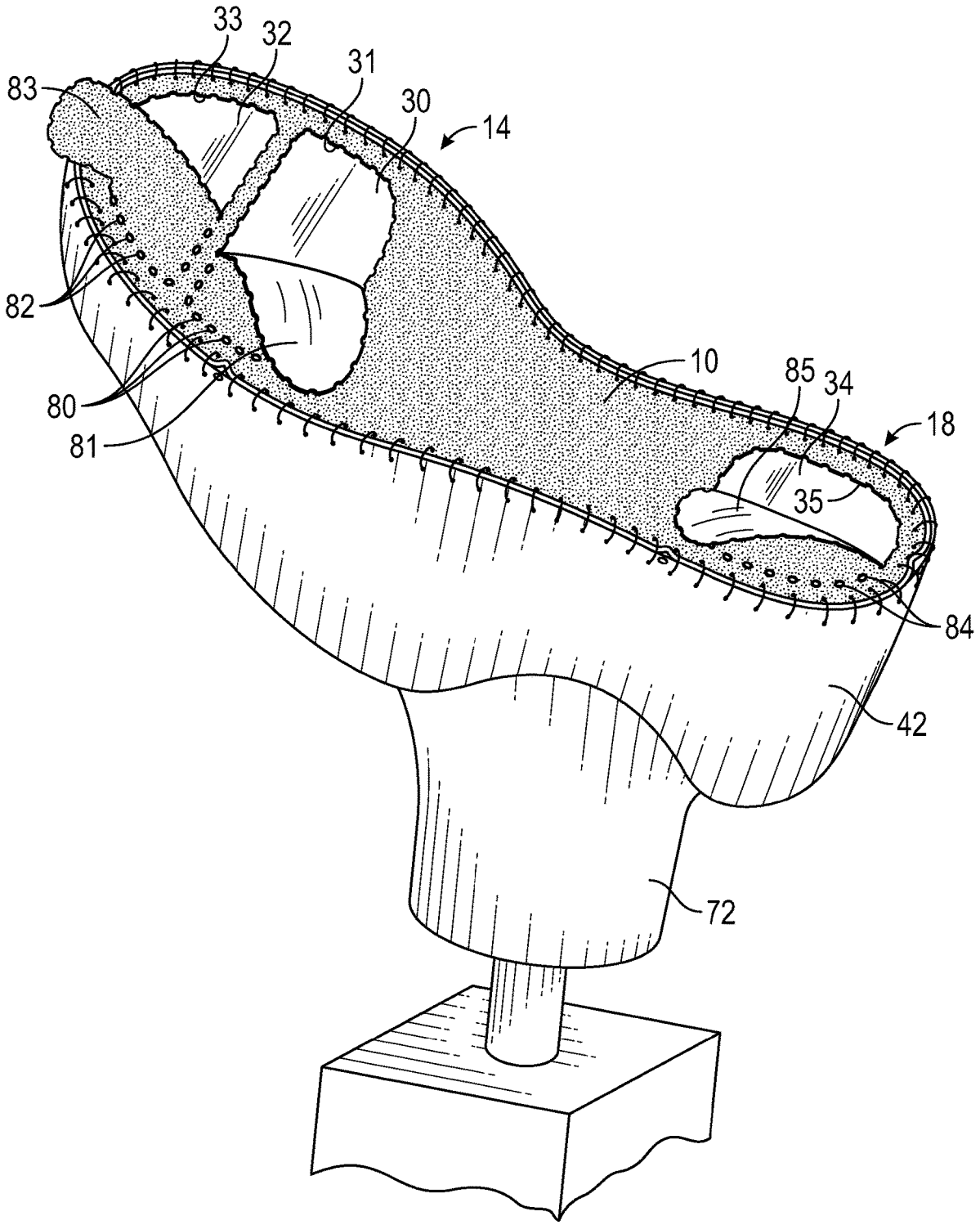
FIG. 16 is a perspective view of the lasted upper and strobel of FIG. 15 with portions of the strobel being removed at perforations to define through holes.

In FIG. 16, after the adhesive 76 is disposed on the strobel 10, the portion 81 of the strobel 10 in the forefoot region 14 is removed by tearing the strobel 10 at the perforations 80. This defines the edge 31 and the first forefoot through hole 30. Another portion 83 of the strobel 10 in the forefoot region 14 is removed by tearing the strobel 10 at the perforations 82. This defines the edge 33 and the second forefoot through hole 32. Additionally, a portion 85 strobel 10 in the heel region 18 is removed by tearing the strobel 10 at the perforations 84. This defines the edge 35 and the heel through hole 34. In addition, the portion 81, 83, 85 of the strobel 10 removed at the perforations 80, 82, 84 may be recycled.

Figure 17:
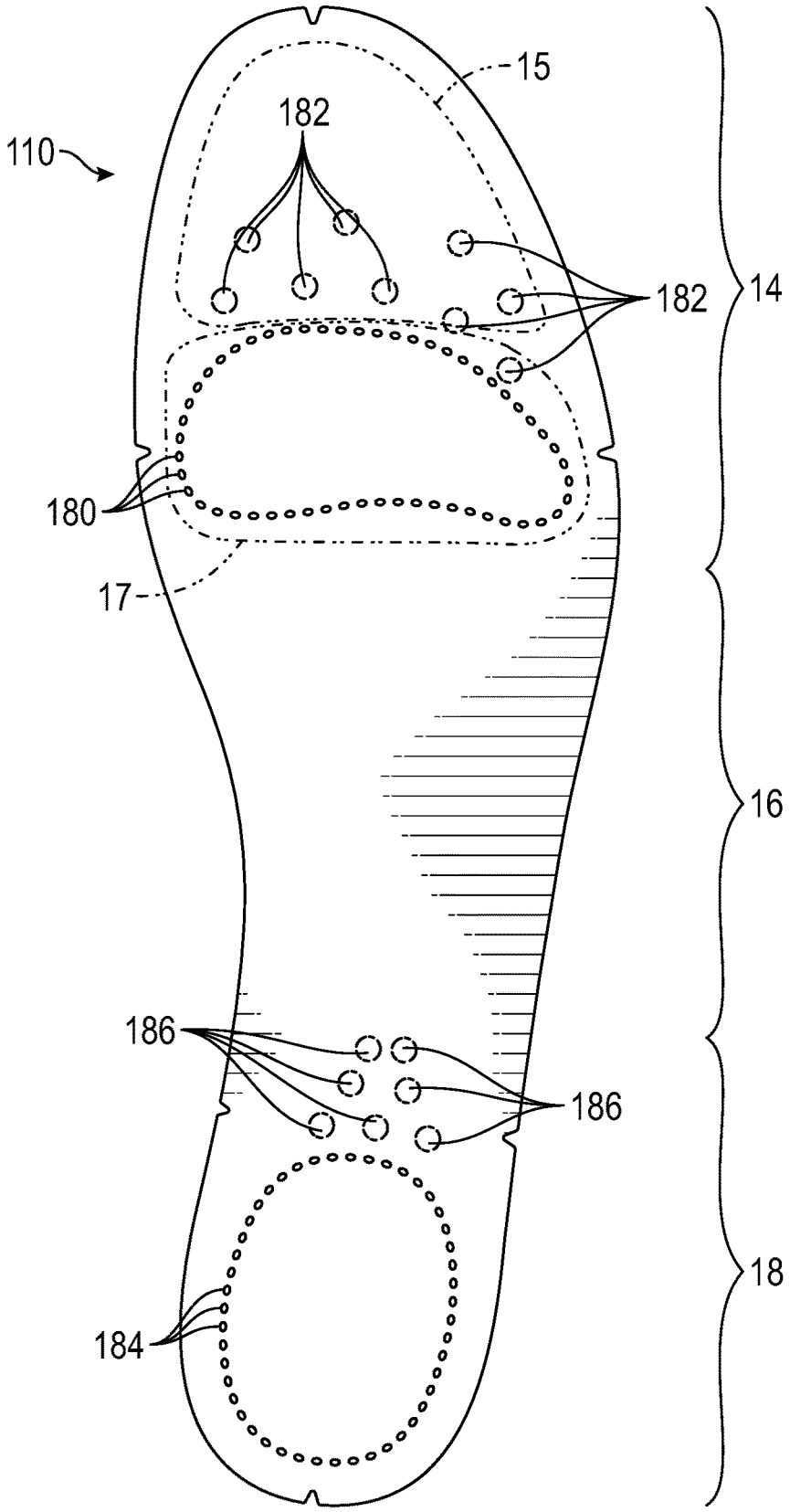
FIG. 17 is a top view of a strobel having perforations in accordance with another aspect of the disclosure.

FIG. 17 shows an embodiment of a strobel 110 that can be used in the article of footwear 40 in place of strobel 10. The strobel 110 is provided with perforations that define the edges of through holes. For example, in the metatarsal head region 17, perforations 180 are provided that define the shape of the edge of a first forefoot through hole. A plurality of perforations 182 that define edges of additional, relatively small, forefoot through holes are substantially in the phalangeal region 15. In the heel region 18, perforations 184 are provided in the shape of the edge of a first heel through hole. A plurality of perforations 186 define edges of additional, relatively small, heel through holes substantially in the heel region 18 between the perforations 184 and the midfoot region 16. The midfoot region 16 is free of perforations and through holes.

Figure 18:
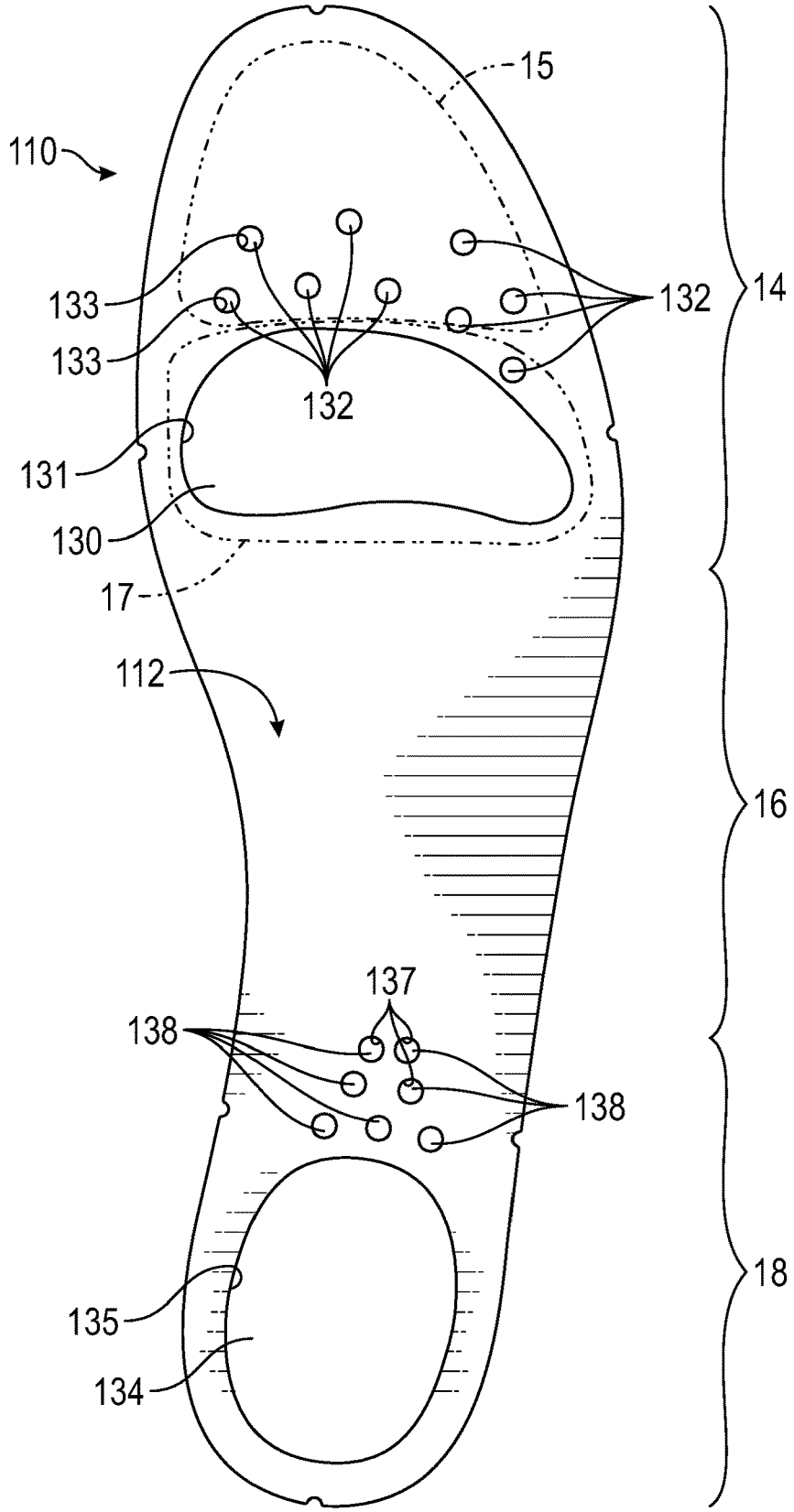
FIG. 18 is a top view of the strobel of FIG. 17 with portions removed at the perforations to define through holes.

Referring to FIG. 18, when portions of the strobel 110 at the perforations 180, 182, 184, 186 of FIG. 17 are removed in a manner similar to that described with respect to the perforations 80, 82, 84 of FIG. 15, through holes 130, 132, 134, 138 are established in the strobel 110 extending through the strobel 110 from a foot support surface 112 to an opposite distal surface. The edge 131 of the strobel 110 defines the first forefoot through hole 130 in the metatarsal head region 17. Edges 133 (only some of which are labeled) define additional forefoot through holes 132 in the phalangeal region 15. The additional forefoot through holes 132 are each relatively small. For example, each has a width far smaller than the width of the strobel 10 in the forefoot region 14. However, their number and proximity to one another may increase the flexibility of the strobel 110 and minimize its impact on an underlying sole structure in the phalangeal region 15 in that the cushioning effects of an underlying midsole may be transmitted directly to a foot resting on the strobel 110 at the locations of the through holes 132.

When portions of the strobel 110 at perforations 184 are removed, the strobel 110 has an edge 135 that defines a relatively large first heel through hole 134. When portions of the strobel 110 at perforations 186 are removed, the strobel 110 has edges 137 (only some of which are labeled) that define a plurality of additional heel through holes 138 substantially in the heel region 18 between the first heel through hole 134 and the midfoot region 16. The plurality of additional heel through holes 138 are surrounded by the strobel 110. As with the additional forefoot through holes 132, the additional heel through holes 138 may each be relatively small, but their number and proximity to one another may increase the flexibility of the strobel 110 and minimize its impact on underlying sole structure in the heel region 18.

Figure 19:
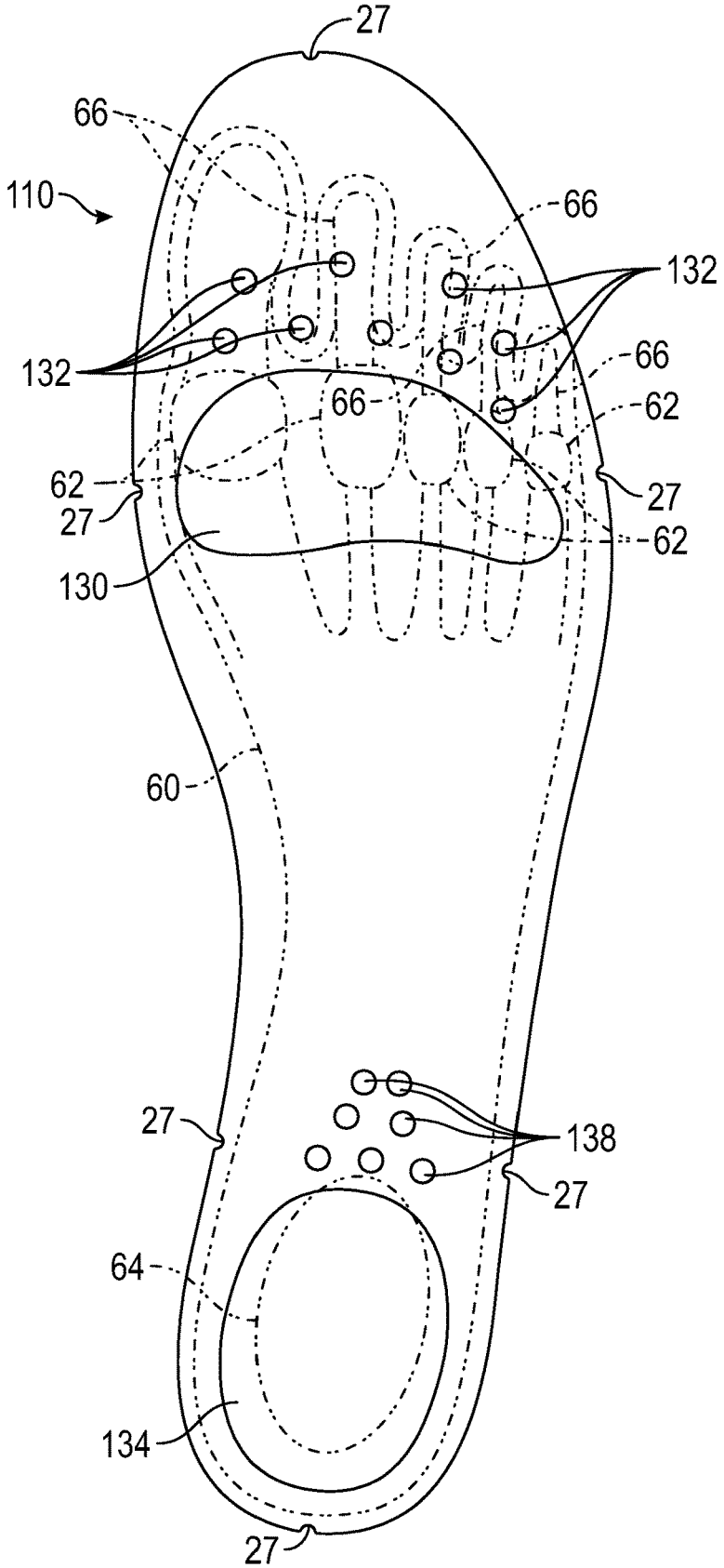
FIG. 19 is a top view of the strobel of FIG. 18 with a foot shown in phantom resting on the strobel.

Referring to FIG. 19, the foot 60 previously described herein is shown in phantom resting on the strobel 110 in the position it will be in when inserted into the article of footwear 40 (with the strobel 110 used in place of strobel 10). The metatarsal heads 62 are disposed substantially directly over the first forefoot through hole 130. Phalanges 66 are disposed substantially directly over the additional forefoot through holes 132. The calcaneus bone 64 is disposed substantially directly over the first heel through hole 134. Additional heel through holes 138 are just forward of the calcaneus bone 64 in the heel region 18.

Figure 20:
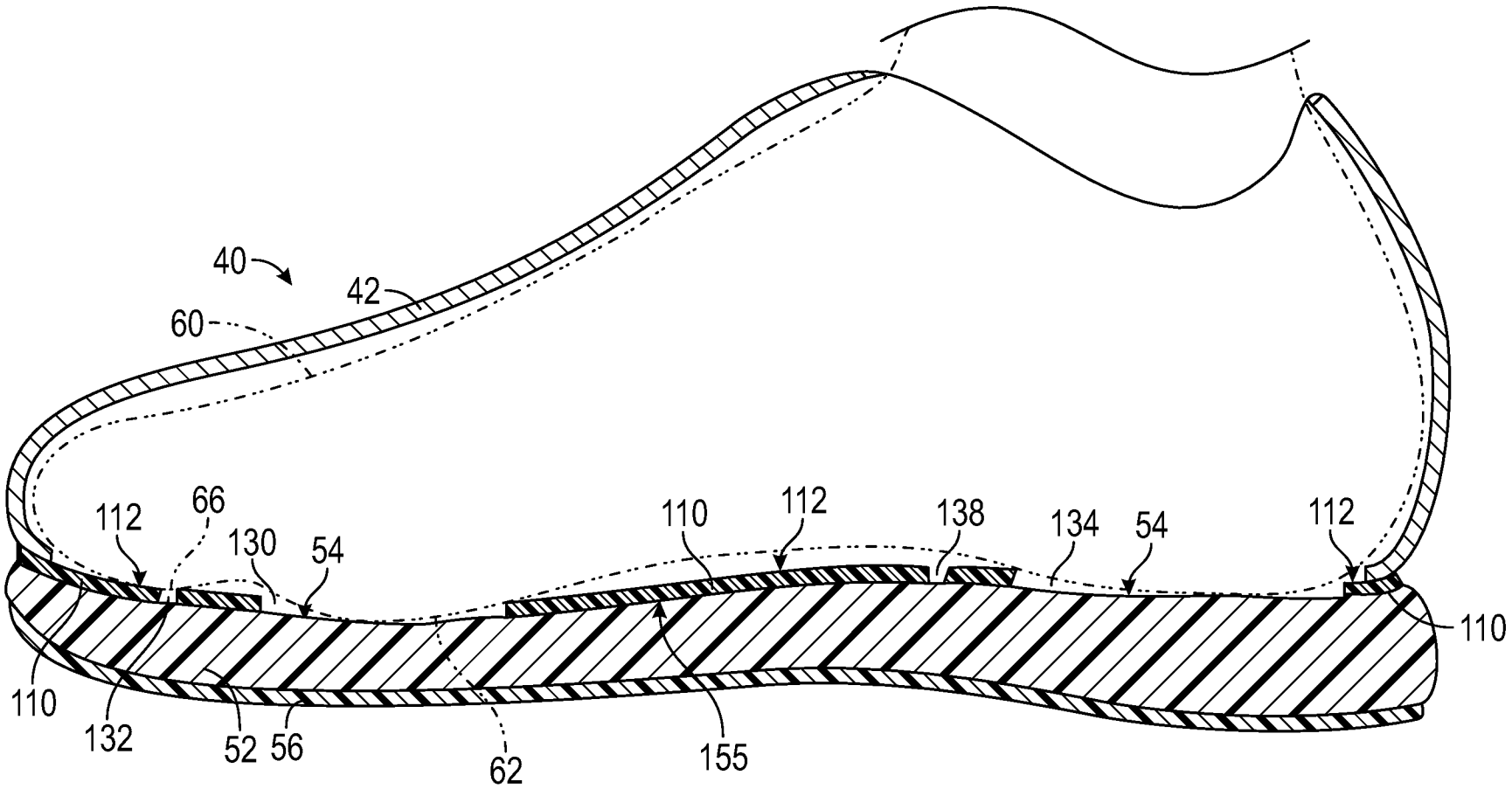
FIG. 20 is a cross-sectional view of an article of footwear with the strobel of FIG. 18.

FIG. 20 shows the distal surface 155 of the strobel 110 is secured to the proximal surface 54 of the midsole 52. The foot 60 is supported on the strobel 110, with the metatarsal heads 62 extending over the first forefoot through hole 130 and supported on the midsole 52 without the strobel 110 between the metatarsal heads 62 and the midsole 52. The phalanges 66 extend over the additional forefoot through holes 132 and are supported on the midsole 52 without the strobel 110 between the phalanges 66 and the midsole 52 at the through holes 132. The calcaneus bone 64 of the heel extends over the first heel through hole 134 and is supported on the midsole 52 without the strobel 110 between the calcaneus bone 64 and the midsole 52. The additional heel through holes 138 are just forward of the calcaneus bone 64 in the heel region 18. Therefore, in addition to portions of the foot resting on the foot support surface 112 of the strobel 110, portions of the foot 60 with the highest pressure loading (as determined by measurements resulting in the foot pressure map 70 of FIG. 4) rest directly on the proximal surface 54 of the midsole 52. The support surface 112 and the proximal surface 54 together define the foot support surface on which the foot 60 directly rests. These highly loaded portions of the foot 60 are therefore subjected more directly to the resilient cushioning of the midsole 52, without the inelastic strobel 110 intervening and potentially altering the effect of the midsole cushioning.

Figure 21:
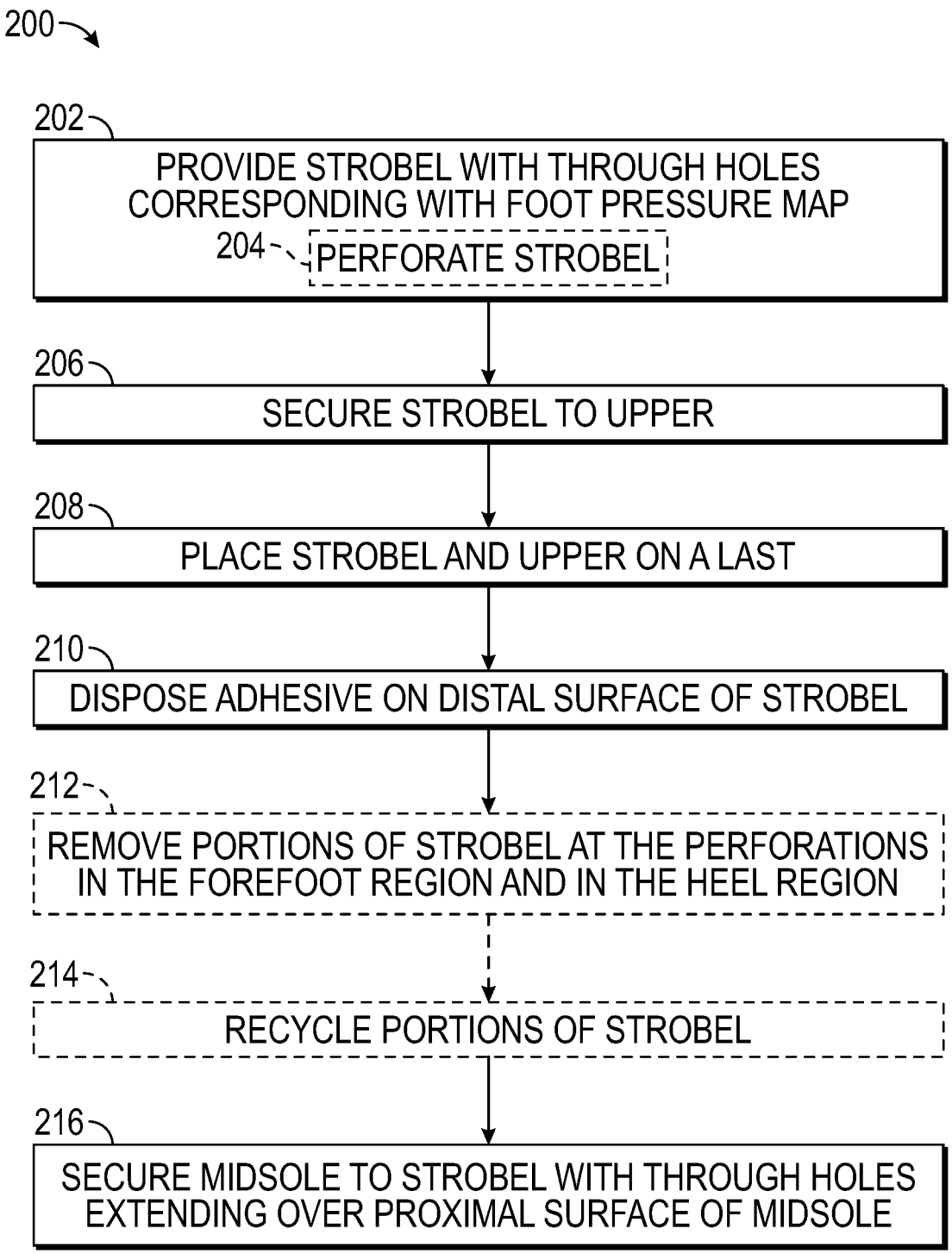
FIG. 21 is a flowchart illustrating a method of manufacturing an article of footwear with any of the strobels disclosed herein.

FIG. 21 shows a flowchart illustrating the steps of a method 200 of manufacturing any of the strobels 10, 110 of the present disclosure as shown and described herein. The method 200 begins with step 202, providing a strobel with a forefoot through hole and a heel through hole each having a shape and/or position corresponding with a foot pressure map. For strobels in which the through holes are provided by removing portions of the strobel at perforations, step 202 may include sub step 204, perforating the strobel. Step 204, step 212 and step 214 are shown in dashed lines as these steps apply to only a subset of the strobels manufactured according to the method 200.

Next, in step 206, the strobel is secured to an upper, such as by stitching. The strobel with the upper secured thereto are then placed on a last in step 208. Adhesive is then disposed on the distal surface of the strobel in step 210, avoiding the through holes in embodiments in which the through holes are already provided at the time the strobel and upper are placed on the last (e.g., embodiments not having perforations at which portions are removed after the adhesive is disposed on the strobel).

In embodiments in which the strobel is perforated, the method 200 includes step 212, removing portions of the strobel at the perforations in the forefoot region and in the heel region to thereby provide the forefoot and heel through holes. In such embodiments, the removed portions can then be recycled in step 214. Next, the midsole is secured to the strobel at the adhesive in step 216, with the through holes extending over the proximal surface of the midsole.

Figure 22:
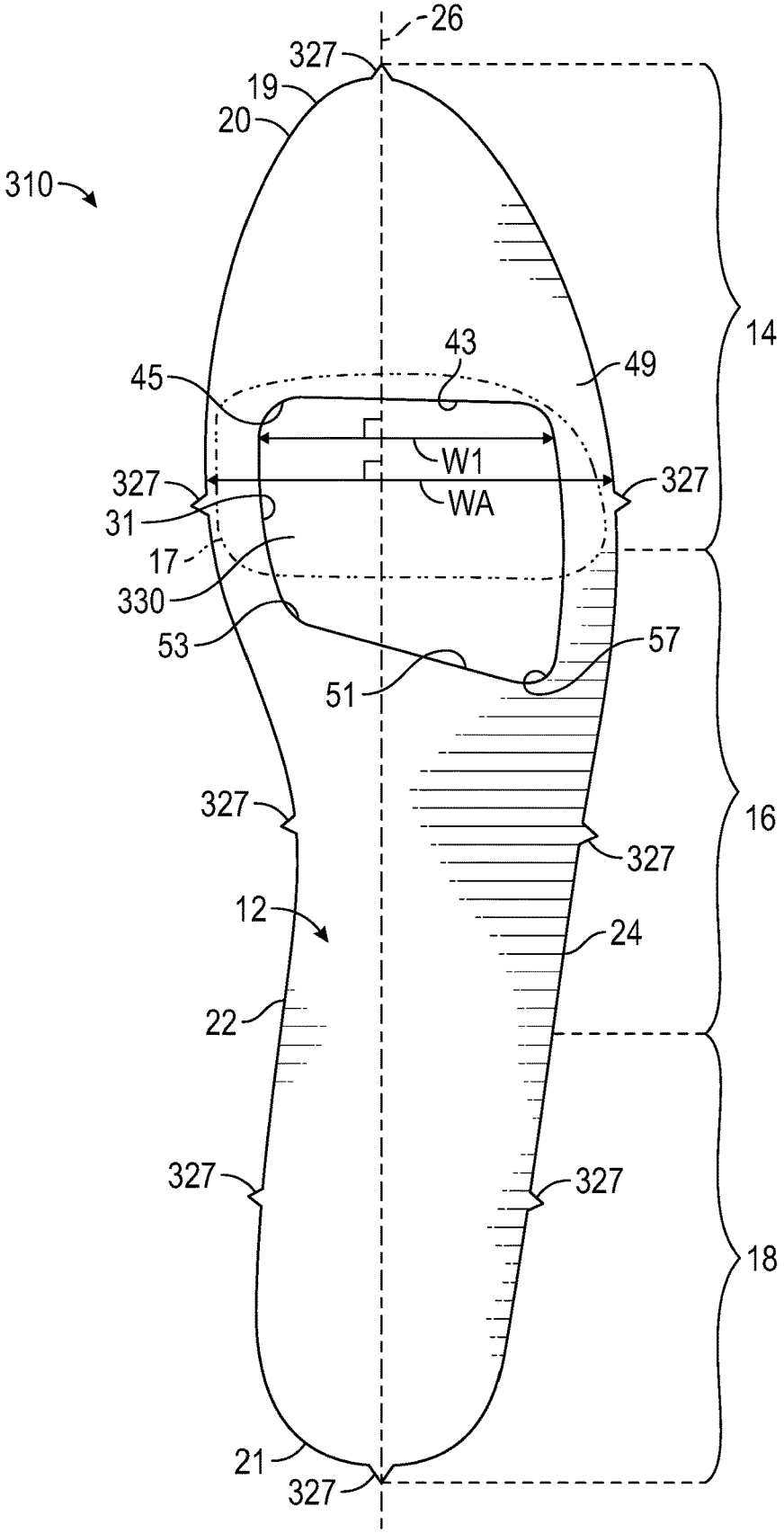
FIG. 22 is a top view of a strobel in accordance with another aspect of the disclosure.

FIG. 22 shows an embodiment of a strobel 310 that may be used in place of strobel 10 in the article of footwear 40 and alike in all aspects to strobel 10 (including materials and lasting processes) except as discussed herein. The strobel 310 has a first forefoot through hole 330. Like strobel 10, the through hole 330 may correspond to a metatarsal head region 17 of a foot and relatively high pressure zones of a pressure map 70 thereof. The through hole 330 may extend partially into the midfoot region 16 as well. Additionally, the through hole 330 may be perforated or laser cut. The through hole 330 may have a maximum width W1 greater than 50 percent of a maximum width WA of the strobel 310 in the forefoot region 14. Locating features 327 are shown as protrusions in the outer edge 20 of the strobel 310 and are disposed in the same locations as and serve the same function as the locating features 27 that are notches.

The front edge 43 of the first forefoot through hole 330 is straight between a rounded forward medial corner 45 and a rounded forward lateral corner 49 of the first forefoot through hole 330. A rear edge 51 of the first forefoot through hole 330 is straight between a rounded rear medial corner 53 and a rounded rear lateral corner 57 of the first forefoot through hole 330. Additionally, the width WC of the strobel 310 bounding the edge 31 of the through hole 330 at lateral and medial sides of the first forefoot through hole 330 is constant, as defined herein.

Figure 23:
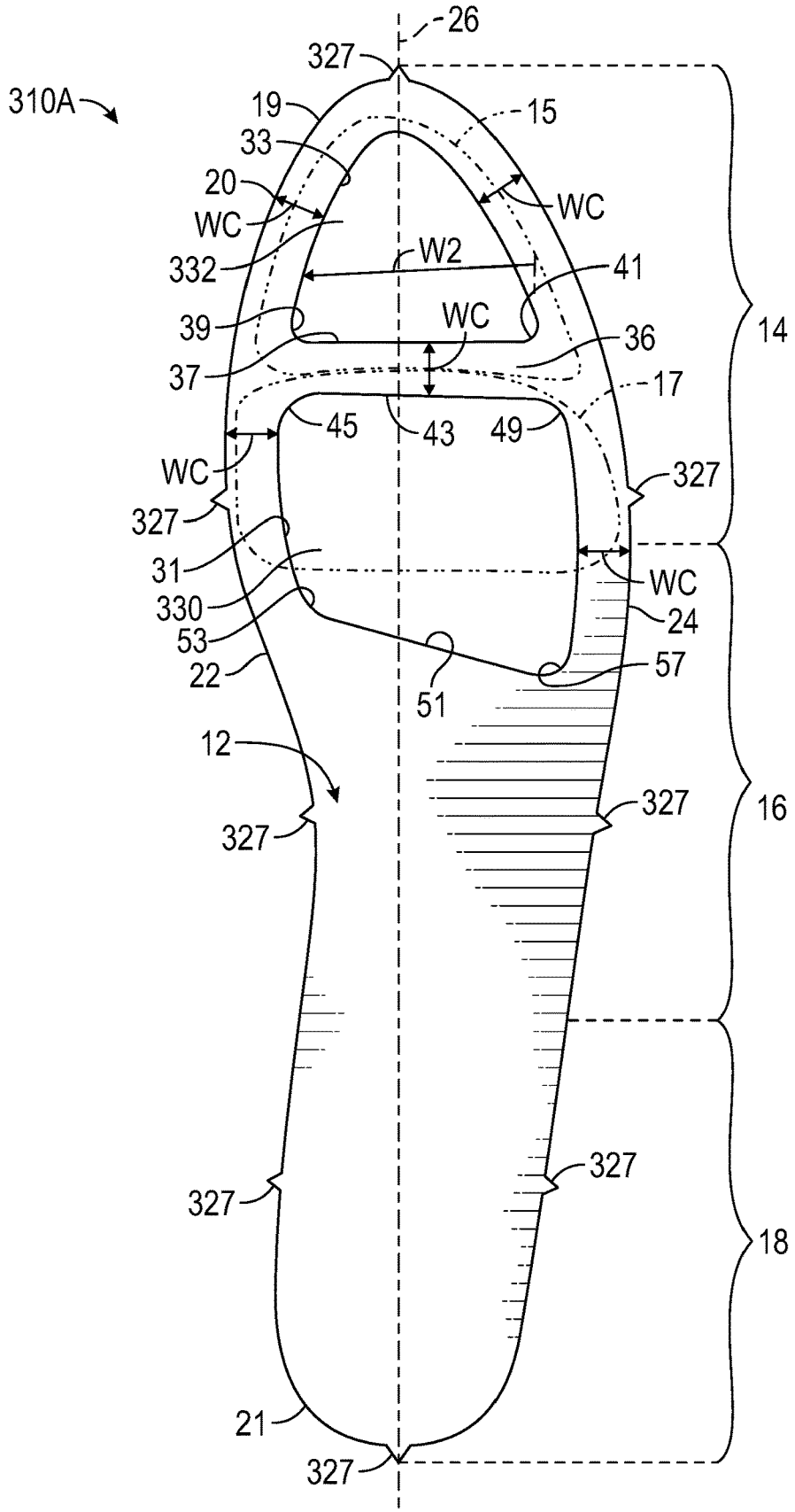
FIG. 23 is a top view of a strobel in accordance with another aspect of the disclosure.

FIG. 23 shows a strobel 310A for use in place of strobel 10 in the article of footwear 40 and alike strobel 310 in all aspects except that strobel 310A includes a second forefoot through hole 332 forward of the first forefoot through hole 330 and in the phalangeal region 15 of the strobel 310A. The second forefoot through hole 332 has a rear edge 37 that is straight between the rounded medial corner 39 and a rounded lateral corner 41 of the second forefoot through hole 332. The second forefoot through hole 332 may also have a width W2 greater than 50 percent of the maximum width WA of the strobel 310A in the forefoot region 14. Like strobel 10, a strip 36 of the strobel 310A extends between and separates the first and second through holes 330, 332. The strobel 310A extends continuously from the medial side edge 22 to the lateral side edge 24 at the strip 36. Additionally, the width WC of the strobel 310A bounding the edge 31 of the through hole 330 at lateral and medial sides of the first forefoot through hole 330 and bounding the edge 33 of the through hole 332 at lateral and medial sides of the second forefoot through hole 332 is constant, as defined herein.

Figure 24:
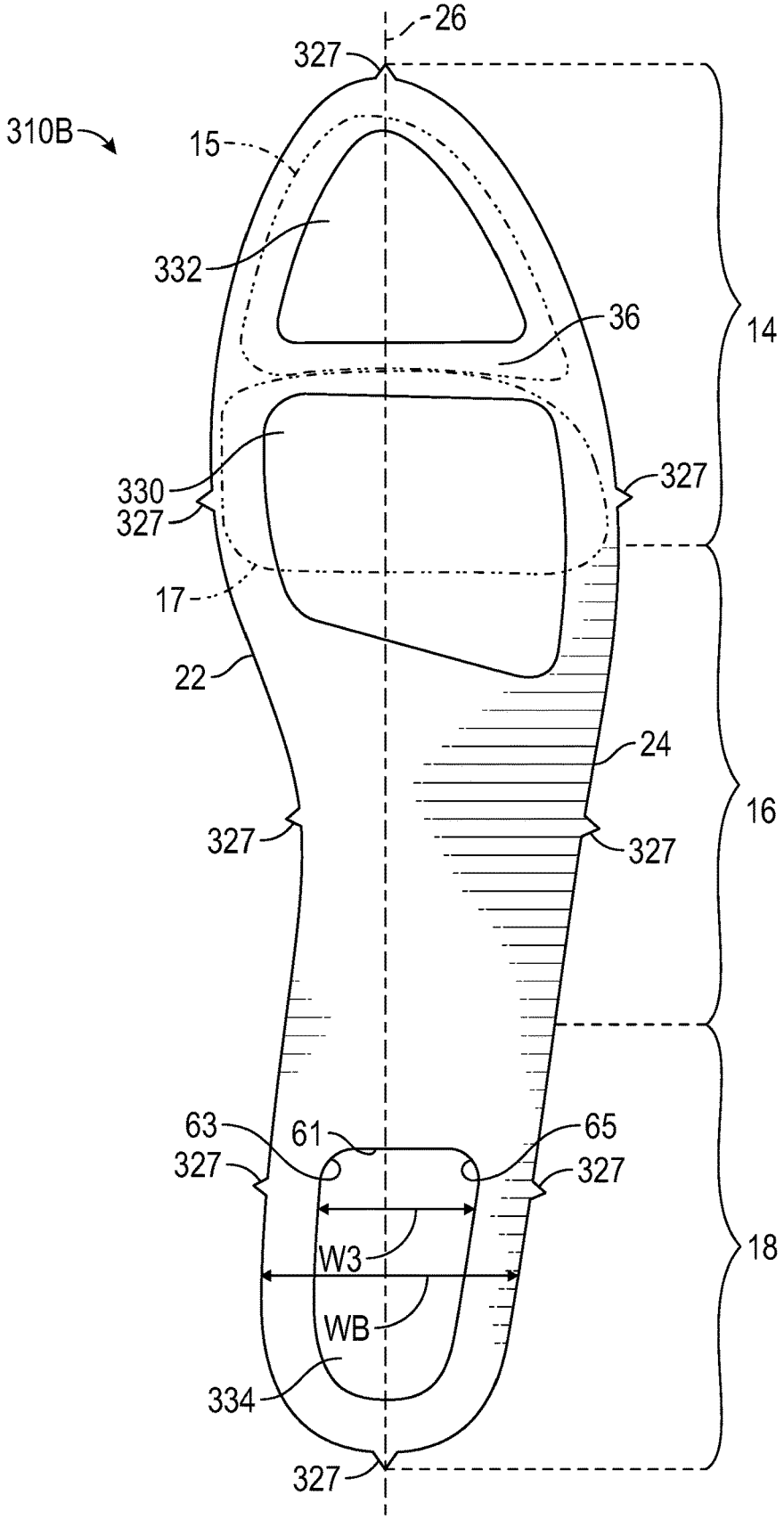
FIG. 24 is a top view of a strobel in accordance with another aspect of the disclosure.

FIG. 24 shows a strobel 310B for use in place of strobel 10 in the article of footwear 40 and alike in all aspects to strobel 310A except that strobel 310B also has a heel through hole 334 in the heel region 18 of the strobel 310B. The heel through hole 334 has a maximum width W3 greater than 50 percent of a maximum width WB of the strobel 310B in the heel region 18. A front edge 61 of the heel through hole 334 is straight between a rounded forward medial corner 63 and a rounded forward lateral corner 65 of the heel through hole 334.

Figure 25:
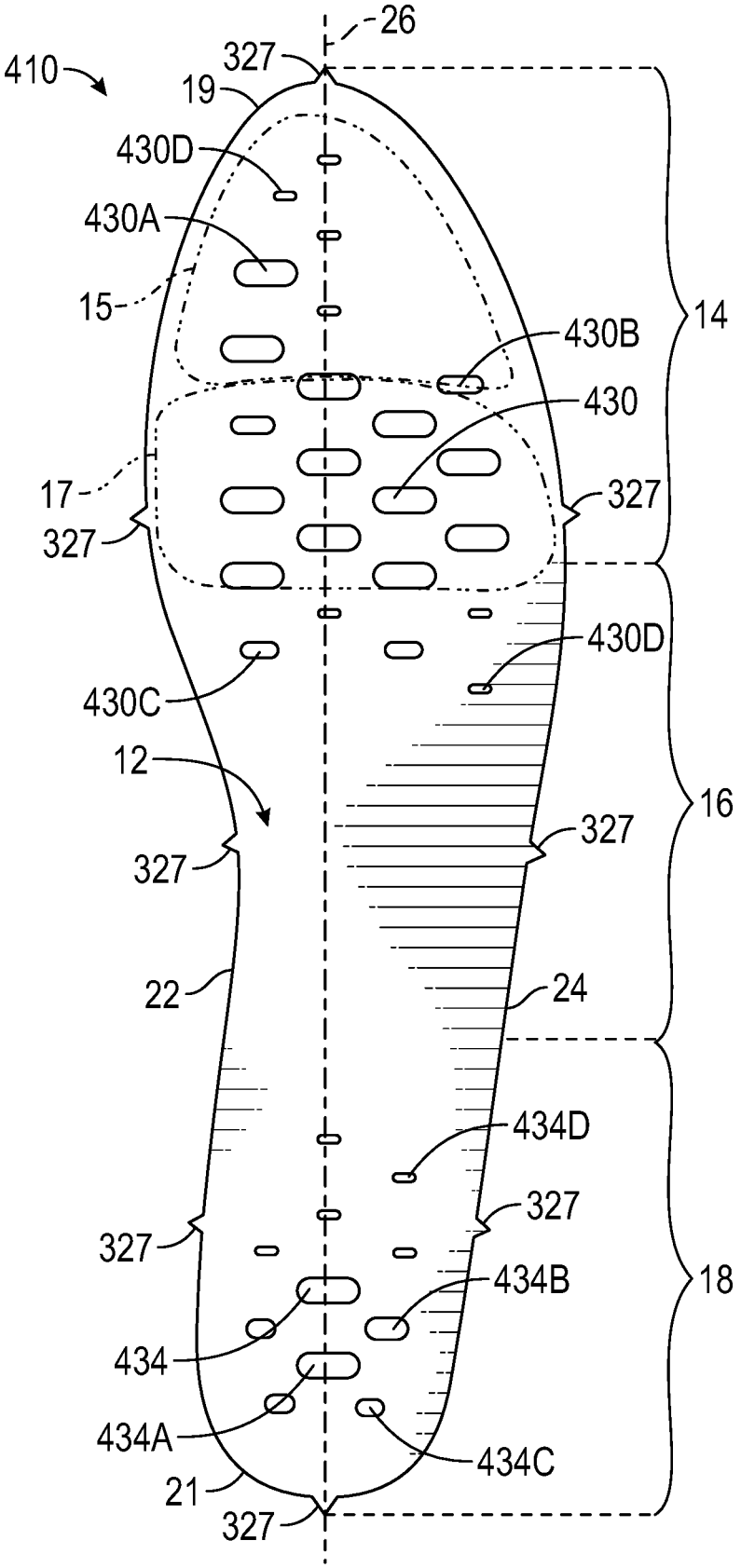
FIG. 25 is a top view of a strobel in accordance with another aspect of the disclosure.

FIG. 25 shows a strobel 410 for use in place of strobel 10 in the article of footwear 40 and alike in all aspects to strobel 10 except as discussed herein. The strobel 410 has a first forefoot through hole 430 in the metatarsal head region 17, and a plurality of additional forefoot through holes 430A, 430B, 430C, and 430D of various sizes, both forward of and rearward of the first forefoot through hole 430 in the forefoot region 14, including in the phalangeal region 15. Only some of the forefoot through holes 430, 430A, 430B, 430C, 430D of each size are labeled. The forefoot through holes 430A have the same width in the transverse direction (e.g., a direction from the medial side edge 22 to the lateral side edge 24) and the same length in the longitudinal direction (e.g., the direction from the forward edge 19 to the rear edge 21) as the first forefoot through hole 430. The forefoot through holes 430B, 430C, and 430D are of progressively smaller widths and lengths than the through holes 430A. Each of the forefoot through holes 430, 430A, 430B, 430C, and 430D has a width in the transverse direction of the strobel 410 that is greater than its length in the longitudinal direction of the strobel 410. Additionally, each has a rounded periphery, making each appear as an elongated slot extending in the transverse direction further than in the longitudinal direction.

The strobel 410 also has a first heel through hole 434 and a plurality of additional heel through holes 434A, 434B, 434C, 434D in the heel region 18, only some of which are labelled. Heel through holes 430 and 430A have the same length and width as one another, and heel through holes 434B, 434C, and 434D are of progressively smaller widths and lengths. The midfoot region 16 has very few through holes (and may have no through holes in some embodiments) in comparison to the forefoot and heel regions 14, 18. Each of the heel through holes 434, 434A, 434B, 434C, and 434D has a width in the transverse direction of the strobel 410 that is greater than its length in the longitudinal direction of the strobel 410. Additionally, each has a rounded periphery, making each appear as an elongated slot extending in the transverse direction further than in the longitudinal direction. The through holes 430, 430A, 430B, 430C, 430D, 434, 434A, 434B, 434C and 434D may be disposed and sized in accordance with a foot pressure map as discussed with respect to foot pressure map 70 of FIG. 4. Accordingly, a greater number of through holes and larger ones of the through holes are disposed in areas of greater loading. The forefoot and heel through holes of the strobel 410 may be perforated or laser cut.

Figure 26:
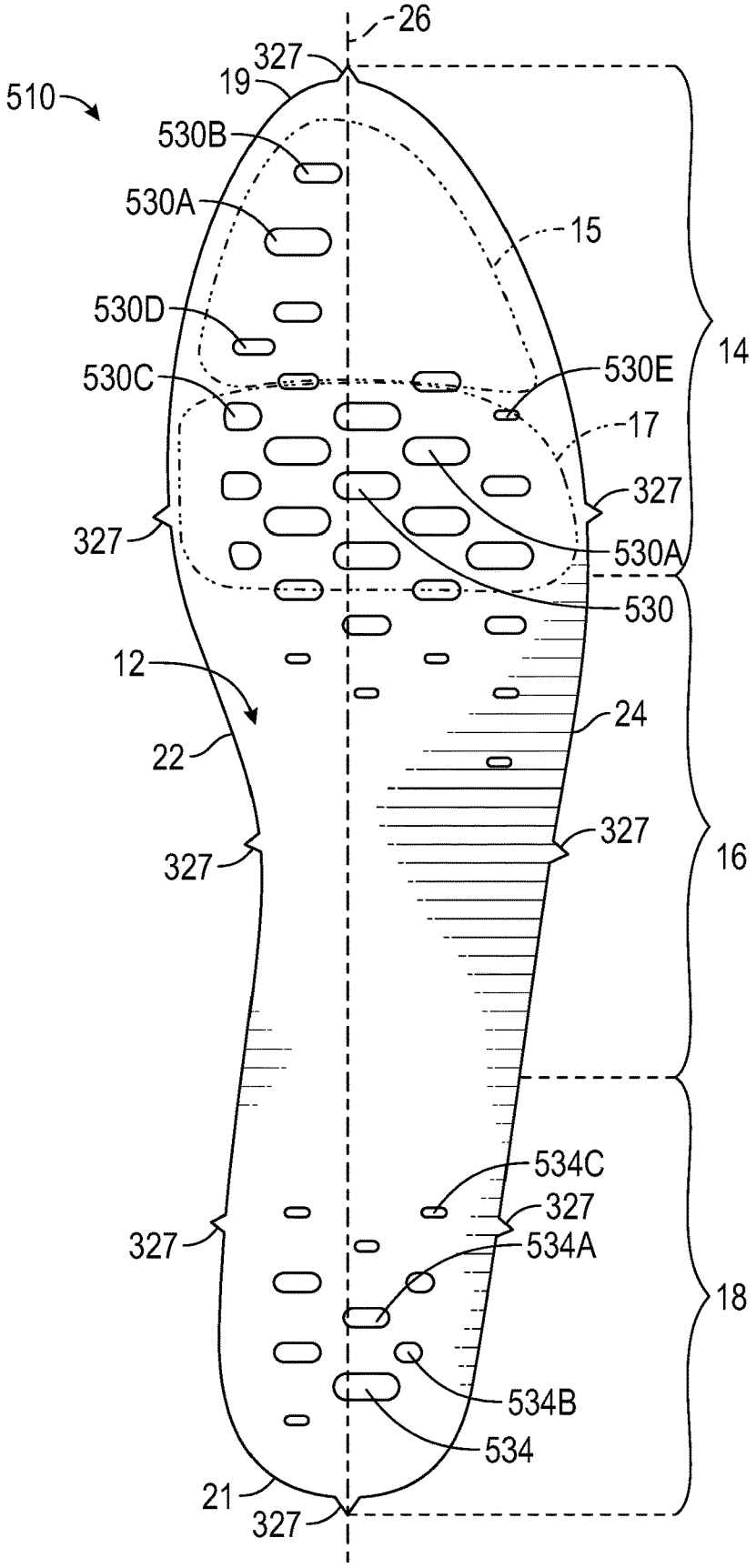
FIG. 26 is a top view of a strobel in accordance with another aspect of the disclosure.

FIG. 26 shows a strobel 510 that is alike in all aspects to strobel 410, except that the strobel 510 is for a larger foot size and has through holes that may be disposed according to a slightly different foot pressure map representative of loading of a wearer or a population average of the wearers of the larger foot size. Accordingly, a first forefoot through hole 530 is larger in length and width than through hole 430, and some of the additional forefoot through holes 530A may be of the same larger size. Forefoot through holes 530B, 530C, 530D and 530E are of progressively smaller widths and lengths, but all having greater widths in the transverse direction of the strobel 310 than lengths in the longitudinal direction of the strobel 310.

The strobel 510 also has a first heel through hole 534 and a plurality of additional heel through holes 534A, 534B, 534C in the heel region 18. Heel through holes 534A, 534B, and 534C are of progressively smaller widths and lengths. The midfoot region 16 has very few through holes (and may have no through holes in some embodiments) in comparison to the forefoot and heel regions 14, 18. Each of the heel through holes 534, 534A, 534B, and 534C has a width in the transverse direction of the strobel 510 that is greater than its length in the longitudinal direction of the strobel 510. Additionally, each has a rounded periphery, making each appear as an elongated slot extending in the transverse direction further than in the longitudinal direction. The through holes 530, 530A, 530B, 530C, 530D, 530E, 534, 534A, 534B, and 534C may be disposed and sized in accordance with a foot pressure map as discussed with respect to foot pressure map 70 of FIG. 4. Accordingly, a greater number of through holes and larger ones of the through holes are disposed in areas of greater loading. The forefoot and heel through holes of the strobel 510 may be perforated or laser cut.

Accordingly, by providing through holes in a strobel with the shape and/or position of a forefoot through hole and a heel through hole based on a foot pressure map, the benefits of a strobel with respect to precision lasting of an upper are achieved without impeding the cushioning and other performance aspects of an underlying midsole.

The following Clauses provide example configurations of a strobel, an article of footwear, and a method of manufacturing disclosed herein.

Clause 1: An article of footwear comprising: a strobel having a forefoot region, a midfoot region, and a heel region; wherein the strobel defines a forefoot through hole in the forefoot region and a heel through hole in the heel region; and wherein the shape, the position, or both the shape and the position of the forefoot through hole and the heel through hole are based on a foot pressure map.

Clause 2: The article of footwear of Clause 1, further comprising: a midsole having a proximal surface secured to the strobel; wherein the forefoot through hole and the heel through hole span over the proximal surface of the midsole; and wherein the strobel, the proximal surface of the midsole at the forefoot through hole, and the proximal surface of the midsole at the heel through hole together define a foot support surface.

Clause 3: The article of footwear of Clause 2, further comprising an adhesive layer at which a distal surface of the strobel is adhered to the proximal surface of the midsole.

Clause 4: The article of footwear of Clause 3, wherein the adhesive layer does not extend across the proximal surface of the midsole at the forefoot through hole or at the heel through hole.

Clause 5: The article of footwear of any of Clauses 1-4, wherein an edge of the strobel surrounding the through hole in the forefoot region and an edge of the strobel surrounding the through hole in the heel region is defined by perforation.

Clause 6: The article of footwear of any of Clauses 1-5, wherein: the forefoot region encompasses a phalangeal region and a metatarsal head region, with the phalangeal region between a forward edge of the strobel and the metatarsal head region, and the metatarsal head region between the phalangeal region and the midfoot region; and the forefoot through hole is in the metatarsal head region.

Clause 7: The article of footwear of Clause 6, wherein: the forefoot through hole has a maximum width greater than 50 percent of a maximum width of the strobel in the forefoot region.

Clause 8: The article of footwear of Clause 7, wherein the forefoot through hole is a first forefoot through hole, and the strobel defines a second forefoot through hole substantially in the phalangeal region, the second forefoot through hole surrounded by the strobel, and having a maximum width greater than 50 percent of a maximum width of the strobel in the phalangeal region.

Clause 9: The article of footwear of Clause 8, wherein: a rear edge of the second forefoot through hole is straight between a rounded medial corner and a rounded lateral corner of the second forefoot through hole; a front edge of the first forefoot through hole is straight between a rounded forward medial corner and a rounded forward lateral corner of the first forefoot through hole; and a rear edge of the first forefoot through hole is straight between a rounded rear medial corner and a rounded rear lateral corner of the first forefoot through hole.

Clause 10: The article of footwear of Clause 9, wherein a width of the strobel bounding lateral and medial sides of the first forefoot through hole and bounding lateral and medial sides of the second forefoot through hole is constant.

Clause 11: The article of footwear of Clause 6, wherein the forefoot through hole is a first forefoot through hole, and the strobel defines a plurality of additional forefoot through holes substantially in the phalangeal region.

Clause 12: The article of footwear of Clause 11, wherein the additional forefoot through holes each have a width in a transverse direction of the strobel greater than a length in a longitudinal direction of the strobel.

Clause 13: The article of footwear of any of Clauses 1-11, wherein the heel through hole is a first heel through hole, and the strobel defines a plurality of additional heel through holes substantially in the heel region between the first heel through hole and the midfoot region, the plurality of additional heel through holes surrounded by the strobel.

Clause 14: The article of footwear of Clause 13, wherein the additional heel through holes each have a width in a transverse direction of the strobel greater than a length in a longitudinal direction of the strobel.

Clause 15: The article of footwear of any of Clauses 1-11, wherein: the heel through hole has a maximum width greater than 50 percent of a maximum width of the strobel in the heel region; and a front edge of the heel through hole is straight between a rounded forward medial corner and a rounded forward lateral corner of the heel through hole.

Clause 16: The article of footwear of any of Clauses 1-15, further comprising: an upper secured to an outer periphery of the strobel and defining a foot-receiving cavity over the strobel.

Clause 17: The article of footwear of any of Clauses 1-15, wherein the strobel is a recyclable material.

Clause 18: An article of footwear comprising: a strobel having a forefoot region, a midfoot region, and a heel region; wherein the strobel defines a forefoot through hole in the forefoot region: the forefoot through hole has a maximum width greater than 50 percent of a maximum width of the strobel in the forefoot region; a front edge of the forefoot through hole is straight between a rounded front medial corner and a rounded front lateral corner of the forefoot through hole; and a rear edge of the forefoot through hole is straight between a rounded rear medial corner and a rounded rear lateral corner of the first forefoot through hole.

Clause 19: The article of footwear of Clause 18, wherein the shape, the position, or both the shape and the position of the forefoot through hole is based on a foot pressure map.

Clause 20: The article of footwear of any of Clauses 18-19, wherein a width of the strobel bounding lateral and medial sides of the forefoot through hole is constant.

Clause 21: The article of footwear of any of Clauses 18-20, further comprising: at least one of an additional forefoot through hole having a width greater than 50 percent of a width of the strobel in the forefoot region; and a heel through hole having a width greater than 50 percent of a width of the strobel in the heel region.

Clause 22: A method of manufacturing an article of footwear, comprising: securing a midsole to a strobel; wherein: the strobel has a forefoot region, a midfoot region, and a heel region; the strobel defines a forefoot through hole in the forefoot region and a heel through hole in the heel region; and the shape and/or position of the forefoot through hole and the heel through hole are based on a foot pressure map.

Clause 23: The method of Clause 22, further comprising: securing the strobel to an upper to define a foot-receiving cavity prior to securing the midsole to the strobel.

Clause 24: The method of Clause 23, further comprising: placing the strobel and upper on a last by inserting the last in the foot-receiving cavity.

Clause 25: The method of Clause 24, further comprising: disposing an adhesive on a distal surface of the strobel, or on a proximal surface of the midsole, or on both the distal surface of the strobel and the proximal surface of the midsole; and wherein securing the midsole to the strobel is by positioning the proximal surface of the midsole adjacent to the distal surface of the strobel to adhere the midsole to the strobel with the adhesive.

Clause 26: The method of Clause 25, wherein the adhesive is disposed on the distal surface of the strobel without extending across the forefoot through hole and the heel through hole.

Clause 27: The method of Clause 25, further comprising: perforating the strobel to define perforations in the forefoot region and perforations in the heel region prior to disposing the adhesive on the distal surface of the strobel; removing a portion of the strobel at the perforations in the forefoot region to define the forefoot through hole; and removing a portion of the strobel at the perforations in the heel region to define the heel through hole.

Clause 28: The method of Clause 27, wherein disposing the adhesive on the distal surface of the strobel is prior to removing a portion of the strobel at the perforations in the forefoot region, and before removing a portion of the strobel at the perforations in the heel region.

Clause 29: The method of Clause 28, further comprising: recycling the portion of the strobel removed at the perforations in the forefoot region and the portion of the strobel removed at the perforations in the heel region.

To assist and clarify the description of various embodiments, various terms are defined herein. Unless otherwise indicated, the following definitions apply throughout this specification (including the claims). Additionally, all references referred to are incorporated herein in their entirety.

An "article of footwear", a "footwear article of manufacture", and "footwear" may be considered to be both a machine and a manufacture. Assembled, ready to wear footwear articles (e.g., shoes, sandals, boots, etc.), as well as discrete components of footwear articles (such as a midsole, an outsole, an upper component, etc.) prior to final assembly into ready to wear footwear articles, are considered and alternatively referred to herein in either the singular or plural as "article(s) of footwear".

"A", "an", "the", "at least one", and "one or more" are used interchangeably to indicate that at least one of the items is present. A plurality of such items may be present unless the context clearly indicates otherwise. All numerical values of parameters (e.g., of quantities or conditions) in this specification, unless otherwise indicated expressly or clearly in view of the context, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. As used in the description and the accompanying claims, a value is considered to be "approximately" equal to a stated value if it is neither more than 5 percent greater than nor more than 5 percent less than the stated value. In addition, a disclosure of a range is to be understood as specifically disclosing all values and further divided ranges within the range.

The terms "comprising", "including", and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items. The term "any of" is understood to include any possible combination of referenced items, including "any one of" the referenced items. The term "any of" is understood to include any possible combination of referenced claims of the appended claims, including "any one of" the referenced claims.

For consistency and convenience, directional adjectives may be employed throughout this detailed description corresponding to the illustrated embodiments. Those having ordinary skill in the art will recognize that terms such as "above", "below", "upward", "downward", "top", "bottom", etc., may be used descriptively relative to the figures, without representing limitations on the scope of the invention, as defined by the claims.

The term "longitudinal" refers to a direction extending a length of a component. For example, a longitudinal direction of a shoe extends between a forefoot region and a heel region of the shoe. The term "forward" or "anterior" is used to refer to the general direction from a heel region toward a forefoot region, and the term "rearward" or "posterior" is used to refer to the opposite direction, i.e., the direction from the forefoot region toward the heel region. In some cases, a component may be identified with a longitudinal axis as well as a forward and rearward longitudinal direction along that axis. The longitudinal direction or axis may also be referred to as an anterior-posterior direction or axis.

The term "transverse" refers to a direction extending a width of a component. For example, a transverse direction of a shoe extends between a lateral side and a medial side of the shoe. The transverse direction or axis may also be referred to as a lateral direction or axis or a mediolateral direction or axis.

The term "vertical" refers to a direction generally perpendicular to both the lateral and longitudinal directions. For example, in cases where a sole is planted flat on a ground surface, the vertical direction may extend from the ground surface upward. It will be understood that each of these directional adjectives may be applied to individual components of a sole. The term "upward" or "upwards" refers to the vertical direction pointing towards a top of the component, which may include an instep, a fastening region and/or a throat of an upper. The term "downward" or "downwards" refers to the vertical direction pointing opposite the upwards direction, toward the bottom of a component and may generally point towards the bottom of a sole structure of an article of footwear.

The "interior" of an article of footwear, such as a shoe, refers to portions at the space that is occupied by a wearer's foot when the shoe is worn. The "inner side" of a component refers to the side or surface of the component that is (or will be) oriented toward the interior of the component or article of footwear in an assembled article of footwear. The "outer side" or "exterior" of a component refers to the side or surface of the component that is (or will be) oriented away from the interior of the shoe in an assembled shoe. In some cases, other components may be between the inner side of a component and the interior in the assembled article of footwear. Similarly, other components may be between an outer side of a component and the space external to the assembled article of footwear. Further, the terms "inward" and "inwardly" refer to the direction toward the interior of the component or article of footwear, such as a shoe, and the terms "outward" and "outwardly" refer to the direction toward the exterior of the component or article of footwear, such as the shoe. In addition, the term "proximal" refers to a direction that is nearer a center of a footwear component, or is closer toward a foot when the foot is inserted in the article of footwear as it is worn by a user. Likewise, the term "distal" refers to a relative position that is further away from a center of the footwear component or is further from a foot when the foot is inserted in the article of footwear as it is worn by a user. Thus, the terms proximal and distal may be understood to provide generally opposing terms to describe relative spatial positions.

While various embodiments have been described, the description is intended to be exemplary, rather than limiting and it will be apparent to those of ordinary skill in the art that many more embodiments and implementations are possible that are within the scope of the embodiments. Any feature of any embodiment may be used in combination with or substituted for any other feature or element in any other embodiment unless specifically restricted. Accordingly, the embodiments are not to be restricted except in light of the attached claims and their equivalents. Also, various modifications and changes may be made within the scope of the attached claims.

While several modes for carrying out the many aspects of the present teachings have been described in detail, those familiar with the art to which these teachings relate will recognize various alternative aspects for practicing the present teachings that are within the scope of the appended claims. It is intended that all matter contained in the above description or shown in the accompanying drawings shall be interpreted as illustrative and exemplary of the entire range of alternative embodiments that an ordinarily skilled artisan would recognize as implied by, structurally and/or functionally equivalent to, or otherwise rendered obvious based upon the included content, and not as limited solely to those explicitly depicted and/or described embodiments.

What is claimed is:

1. An article of footwear comprising:

a strobel having a forefoot region, a midfoot region, and a heel region;

wherein the forefoot region encompasses a phalangeal region and a metatarsal head region, with the phalangeal region between a forward edge of the strobel and the metatarsal head region, and the metatarsal head region between the phalangeal region and the midfoot region;

wherein the strobel defines a first forefoot through hole and a second forefoot through hole in the forefoot region, the first forefoot through hole having a maximum width greater than 50 percent of a maximum width of the strobel in the metatarsal head region and the second forefoot through hole having a maximum width greater than 50 percent of the maximum width of the strobel in the phalangeal region; and the strobel further defining a heel through hole in the heel region;

wherein the first forefoot through hole is in the metatarsal head region and the second forefoot through hole is in the phalangeal region, and a strip of the strobel extends between and separates the first forefoot through hole and the second forefoot through hole;

wherein a rear edge of the first forefoot through hole is rounded; and wherein the shape, the position, or both the shape and the position of the first forefoot through hole and the heel through hole are based on a foot pressure map.

2. The article of footwear of claim 1, further comprising:

a midsole having a proximal surface secured to the strobel;

wherein the first forefoot through hole, the second forefoot through hole, and the heel through hole span over the proximal surface of the midsole; and wherein the strobel, the proximal surface of the midsole at the first forefoot through hole, the proximal surface of the midsole at the second forefoot through hole, and the proximal surface of the midsole at the heel through hole together define a foot support surface.

3. The article of footwear of claim 2, further comprising an adhesive layer at which a distal surface of the strobel is adhered to the proximal surface of the midsole.

4. The article of footwear of claim 3, wherein the adhesive layer does not extend across the proximal surface of the midsole at the first forefoot through hole, at the second forefoot through hole, or at the heel through hole.

5. The article of footwear of claim 1, wherein the strobel is a recyclable material.

6. The article of footwear of claim 1, wherein a front edge of the first forefoot through hole is straight between a rounded forward medial corner and a rounded forward lateral corner of the first forefoot through hole.

7. The article of footwear of claim 1, wherein a rear edge of the second forefoot through hole is straight between a rounded rear medial corner and a rounded rear lateral corner of the second forefoot through hole.

8. The article of footwear of claim 1, wherein a front edge of the first forefoot through hole is straight between a rounded forward medial corner and a rounded forward lateral corner of the first forefoot through hole; and wherein a rear edge of the second forefoot through hole is straight between a rounded rear medial corner and a rounded rear lateral corner of the second forefoot through hole.

9. The article of footwear of claim 1, wherein a width of the strobel bounding lateral and medial sides of the first forefoot through hole and bounding lateral and medial sides of the second forefoot through hole is constant.

10. The article of footwear of claim 9, wherein a width of the strobel bounding a foremost edge of the second forefoot through hole is constant and is the same as the width of the strobel bounding the lateral and medial sides of the first forefoot through hole.

11. The article of footwear of claim 1, wherein the strobel includes locating features at an outer edge of the strobel adjacent to a lateral side and a medial side of the first forefoot through hole.

* * * * *